US005691703A

United States Patent [19]

Roby et al.

[11] Patent Number: 5,691,703

[45] Date of Patent: Nov. 25, 1997

[54] MULTI-SIGNATURE FIRE DETECTOR

[75] Inventors: Richard J. Roby; Daniel T. Gottuk; Craig L. Beyler, all of Columbia, Md.

[73] Assignee: Hughes Associates, Inc., Columbia, Md.

[21] Appl. No.: 487,050

[22] Filed: Jun. 7, 1995

[51] Int. Cl.[6] ..... G08G 17/10

[52] U.S. Cl. ..... 340/628; 340/511; 340/522; 340/578; 340/629; 340/630; 358/438

[58] Field of Search ..... 340/628, 629, 340/630, 577, 584, 578, 521, 522, 511; 250/573, 574; 356/438

[56] References Cited

U.S. PATENT DOCUMENTS

| | | | |
|---|---|---|---|
| 4,220,857 | 9/1980 | Bright | 250/339 |
| 4,639,598 | 1/1987 | Kern et al. | 340/578 |
| 4,640,628 | 2/1987 | Seki et al. | 340/577 |
| 4,725,820 | 2/1988 | Kimura | 340/522 |
| 4,785,292 | 11/1988 | Kern et al. | 340/587 |
| 4,871,999 | 10/1989 | Ishii et al. | 340/587 |
| 5,017,906 | 5/1991 | Pantus | 340/522 |
| 5,376,924 | 12/1994 | Kubo et al. | 340/522 |
| 5,486,811 | 1/1996 | Wehrle et al. | 340/576 |

OTHER PUBLICATIONS

"A Fire Detection Algorithm Using Second Order Statistics", *Fire Safety Science*–Proceedings of the Third International Symposium, G. Cox & B. Langford, Elsevier Applied Science, New York 1991, pp. 943–953.

"Correlation Filters for Automatic Fire Detection Systems", *Fire Safety Science*–Proceedings of the First International Symposium, Hemisphere Publishing Corp., New York 1986, p. 1986.

"Approach to Detection of Fires in Their Very Early Stage by Odor Sensors and Neural Net", *Fire Safety Science*–Proceedings of the Third International Symposium, G. Cox & B. Langford, Elsevier Applied Science, New York 1991, pp. 955–964.

"Detection of Smoke: Full–Scale Tests with Flaming and Smouldering Fires", *Fire Safety Science*–Proceedings of the Third International Symposium, G. Cox & B. Langford, Elsevier Applied Science, New York 1991, pp. 975–984.

"Detection of Smoldering Fire in Electrical Equipment with High Internal Air Flow", *Fire Safety Science*–Proceedings of the First International Symposium, Hemisphere Publishing Corp., New York 1986, pp. 699–708.

"Processing of 12th Joint Panel Meeting of the UJNR Panel on Fire Research and Safety", Oct. 27–Nov. 2, 1992, pp. 110–113.

"Fire Detection Using Cross–Correlations of Sensor Signals", *Fire Safety Journal* 18, 1992, pp. 355–374.

"An Algorithm for Improving the Reliability of Detection with Processing of Detection with Processing of Multiple Sensors' Signal", *Fire Safety Journal* 17, 1991, pp. 469–484.

"The Use of Low Power Carbon Monoxide Sensors to Provide Early Warning of Fire", *Fire Safety Journal* 17, 1991, pp. 431–443.

(List continued on next page.)

*Primary Examiner*—Jeffery Hofsass
*Assistant Examiner*—Daniel J. Wu
*Attorney, Agent, or Firm*—Nikaido, Marmelstein, Murray & Oram LLP

[57] ABSTRACT

A multi-signature fire detection method and apparatus, utilizing first and second detectors for detecting first and second fire signatures. The first detector outputs a first signal indicative of the first detected fire signature, and the second detector outputs a second signal indicative of the second detected fire signature. A signal processor is provided for combining the first and second signals using a number of correlations, wherein outputs of the first and second detector means are coupled to the signal processor, and the signal processor compares and combines the first and second signals to a first predetermined reference value, and outputs a fire condition signal if a combination of the first and second signals exceeds the predetermined reference value.

27 Claims, 19 Drawing Sheets

OTHER PUBLICATIONS

"Gas Sensing for Fire Detection: Measurements of CO, $CO_2$, $H_2$, $O_2$, and Smoke Density in European Standard Fire Tests", *Fire Safety Journal* 22, 1994, pp. 181–205.

"A Primitive Study of a Fire Detection Method Controlled by Artificial Neural Net", *Fire Safety Journal* 17, 1991, pp. 535–553.

"Toward More Reliable Residential Smoke Detection Systems", *Journal of Fire Prot. Engr.,* 2(1), 1990, pp. 1–10.

"A Composite Detection Algorithm Using Signal Trend Information of Two Different Sensors", *Fire Safety Journal* 17 (1991), pp. 519–534.

LEGEND

A...
B...
C...
E...
SEE FIG. 3

LEGEND

A= SIMPLEX IONIZATION DETECTOR
B= SIMPLEX HEAT DETECTOR
C= SIMPLEX PHOTOELECTRIC DETECTOR

E= CO GAS SAMPLING PORT
(1/4" TUBE EXTENDING 3" BELOW CEILING)
NOTE: LASER BEAM 7" BELOW CEILING

MULTI-SIGNATURE FIRE DETECTOR

BACKGROUND OF THE INVENTION

1. Field of the Invention

Early detection and control of unwanted fires is and has been a national priority for decades. While specialized detectors were available prior to the development of smoke detectors (ionization and photoelectric), the relatively inexpensive and sensitive smoke detectors have had a major impact on reducing life and property loss due to fire. These technologies are now very mature and extremely affordable. Several problems have been identified with the existing smoke detectors. It was initially assumed that battery powered units were preferable so that detectors would operate even if the fire affected the home's electrical system. However, experience has shown that a large fraction of battery operated units are not operational due to failure to replace batteries. This problem is far more serious than the problem the batteries were intended to solve. In addition, the false alarm rate for smoke detectors has been very high. Typical false to real fire alarms are on the order of 10:1. Breen ("False Fire Alarms in College Dormitories-The Problem Revisited," SFPE Technology Report 85-3, Society of Fire Protection Engineers, Boston, Mass., 1985) has reported false:real alarm ratios of in excess of 50:1 for college dormitories. The failure of occupants to replace batteries in smoke detectors is being addressed through public education and a return to hard wired detectors. False alarm problems are also being addressed by a general reduction in the sensitivity settings of detectors. While this tradeoff appears to be advantageous because of the criticality of alarm credibility, there has been a clear reduction in the level of protection provided.

For clarity, the following definitions are set forth in order to assist in a proper understanding of the subject matter of this document: "Smoke" is defined as the condensed phase component of products of combustion from a fire. "Fire signature" is defined as any fire product that produces a change in the ambient environment. "Fire product" can be smoke, a distinct energy form such as electromagnetic radiation, conducted heat, convected heat, or acoustic energy, or any individual gas such as CO, $CO_2$, NO, etc., which can be generated by a fire. "Multi-signature fire detection" is the measurement of two or more fire signatures, in order to establish the presence of a fire.

2. Description of the Related Art

The current state-of-the-art in fire detection is best summarized by a recent review paper by Grosshandler ("An Assessment of Technologies for Advanced Fire Detection," presented at the ASME Winter Annual Meeting, Symposium on Heat Transfer in Fire and Combustion Systems, Nov. 9–13, 1992) and the Proceedings of the 9th International Conference on Automatic Fire Detection as well as the Proceedings of the 1st (1988), 2nd (1989), and 3rd (1991) Symposium on Fire Safety Science. Research in fire detection can logically be divided into three distinct areas of investigation: novel detectors, improved signal processing, and assessment of the response of detectors to fire and non-fire environments.

Grosshandler presents a very thorough review of novel or innovative sensor technologies. These include particle, chemical, optical, and acoustical sensors. The review includes many technologies which have been actively pursued and others with potential application which have not been investigated specifically for fire detection.

Signal processing methods have received a great deal of attention in this age of microprocessors. Inexpensive computing power and digital electronics have made sophisticated detection algorithms very feasible in commercial systems. It is interesting that for the most part, the algorithms being investigated are generic processing algorithms rather than methods specifically linked to a knowledge of fire dynamics, smoke generation, and other processes involved in the generation of fire signatures. A notable exception is the method of Ishii et al ("An Algorithm for Improving the Reliability of Detection with Processing of Multiple Sensors' Signal," Fire Safety Journal, 17, 1991, pp. 469–484) in which a simple zone fire model is used to deduce source generation rates which are used as data in a cross-correlation algorithm. While this method is interesting, its reliance on zone modeling means that it is not well suited to the earliest stages of the fire where the zone model is not yet valid and detection is desired. Nonetheless, it does represent a direction which needs to be explored. Fortunately, there are many avenues which can be explored which do not include the zone model formalism.

The assessment of fire and non-fire signatures and the response of detectors to these signatures is an area of research that is absolutely critical to the development and evaluation of novel sensors, the refinement of existing sensors and the development of detection algorithms. While there are many standard tests available and researchers routinely use test sources, there has been insufficient attention paid to the question of the types of sources that need to be investigated and how these sources can best be adapted to laboratory research and testing. Comprehensive source types are needed to assure the required performance of detectors to both real fire alarm and nuisance alarm sources. The definition of nuisance alarm sources which simulate false alarm scenarios in particular requires more in depth investigation. Overall success in improving detector performance will be limited until the characterization of real fire and nuisance alarm sources is more fully addressed. One result of importance is the clear indication that test results in moderate scale enclosures can provide excellent insights though attention needs to be paid to scaling the fire sources as well. The work of Heskestad and Newman ("Fire Detection Using Cross-Correlations of Sensor Signals," fire Safety Journal, 18(4), 1992) is a good example of this.

Most false alarms which are not related to hardware problems are the result of non-fire aerosols. Cooking aerosols, dusts, tobacco, aerosol can discharges, and car exhausts are examples of aerosol sources which cause false alarms. Cooking aerosols and steam (e.g., from a shower) are the most common false alarm sources. Of these examples only tobacco smoke and car exhaust are expected to contain carbon monoxide. This makes carbon monoxide an attractive fire signature for detection purposes. The fact that carbon monoxide is the causative agent in a majority of fire deaths further enhances the desirability of using CO as a fire signature. Given the toxic properties of CO, it could be argued that false alarms due to the actual presence of CO in non-fire situations is not a false alarm at all. Rather, such alarms are desirable for the general safety of building occupants.

Based on these factors, the evaluation of the feasibility of a combination smoke detector/CO detector was a major focus of the present invention. There are a wide range of potential methods for detecting CO. These range from electrochemical sensors to IR (infra-red) absorption to oxidizable gas sensors (tin oxide) to gel cells.

Of these methodologies, the oxidizable gas sensors are the least discriminating. Any oxidizable species including hydrocarbons will be detected. The first generation oxidizable gas sensors were developed in the early 1970's and operated at 300°–400° C. Studies at NIST by Bukowski and Bright ("Some Problems Noted in the Use of Taguchi Semiconductor Gas Sensors as Residential Fire/Smoke Detectors," NBSIR 74–591, National Bureau of Standards, Gaithersburg, Md., December 1974) demonstrated the false alarm problems with such detectors and indicated relatively poor performance as a fire detector. The NIST investigators found that the oxidizable gas sensor was very prone to false alarms due to hair sprays, deodorant, rubbing alcohol, cigarettes, and cooking aerosols. These false alarm signatures include many which plague conventional smoke detectors. Thus, the oxidizable gas sensor does little to complement conventional detectors in terms of false alarm resistance. Notably, none of these signatures involve CO. This indicates that a sensor which selectively measures CO would be far more useful in concert with conventional smoke detectors than would be oxidizable gas detectors. It is interesting to note that in recent work done by Harwood et al ("The Use of Low Power Carbon Monoxide Sensors to Provide Early Warning of Fire," Fire Safety Journal, 17, 1991, pp. 431–443), the very same type of oxidizable gas sensor was evaluated and found to be superior to conventional detectors in terms of its ability to detect BS 5445 test fires. These same investigators found the oxidizable gas detector to be resistant to false alarms. It is of interest that they did not include any spray aerosol or cooking aerosol in their testing. These recent findings serve to emphasize the criticality of using realistic sources for evaluating detector performance and false alarm resistance.

Harwood et al pursued further development of oxidizable gas detectors by the addition of Pt to allow ambient temperature operation to reduce power requirements. This enhancement has two disadvantages which are more serious than the power issue. First, the high operating temperature tended to minimize fouling of the detector by moisture and combustible gases which can be a problem at room temperature. This can lead to false alarm problems. Second, the heated sensor notably improved the smoke entry characteristics of the detector housing by a chimney effect. This is lost with room temperature operation. Okayama ("Approach to Detection of Fires in Their Very Early Stage by Odor Sensors and Neural Net," Fire Safety Science-Proceedings of the Third International Symposium, Elsevier Scient Publishers, Ltd., 1991, pp. 955–964) reported work using two different tin oxide detectors of different thicknesses to detect smoldering sources while rejecting non-smoldering volatile materials. This discrimination was successful and may have more general-applicability though the nuisance alarm sources tested by Okayama did not represent normal false alarm sources.

Electrochemical sensors and IR absorption instruments for CO currently exist. Electrochemical sensors are widely used in industrial hygiene applications and IR absorption is widely used in fire and combustion areas. The electrochemical sensors are reasonably affordable (hundreds of dollars), but do require that the cell be replaced periodically. As such, they share some of the same maintenance problems with existing battery operated detectors. IR absorption has been demonstrated to be feasible for measuring ambient ppm levels of CO. The major barrier for these methods is the cost of the required instrumentation. There are definite indications that recent technical developments and mass production economies can overcome the cost issues.

U.S. Pat. No. 4,639,598 (Kern) teaches a fire sensor cross-correlator circuit and method. Kern is concerned with an optical flaming fire sensor system which makes use of the correlation of two radiation sensors in different wavelength regions of the EM spectrum. This patent makes use of the fact that radiation from flaming fires has a primary frequency in the 0.2–5 Hz range, depending on the size of the fire. This property of flaming fires has been widely studied and documented in the fire literature. Through the use of a cross-correlation of the two regions of the EM spectrum in which fires are known to emit radiation, false alarm sources which lack either spectral region in its radiative output or which do not have strong frequency components in the 0.2–5 Hz frequency range are excluded. This provides discrimination between flaming fire and non-fire radiative sources. For these optical flaming fire detection systems, like all fire detection systems, sensitivity to fires is not the limiting aspect of the detection system's usefulness. Rather, the ability to distinguish a fire from a non-fire source is the limiting aspect of these systems. Kern deals with the various aspects of a single fire signature, radiative output of a flaming fire. The present invention, which uses multiple fire signatures, applies to both flaming and smoldering fires, while Kern's methods have no role in smoldering fires.

SUMMARY OF THE INVENTION

The present invention, therefore, is a multi-signature fire detection system, wherein two sensors or detectors detecting different fire signatures are used, and their outputs combined to improve fire detection performance. The use of two detectors according to the claimed invention can detect fires more rapidly and more reliably than either detector could alone. Additionally, the invention results in a fire detection apparatus which is more resistant to false alarms, thereby addressing a significant problem with current detectors.

A multi-signature fire detection apparatus according to the present invention comprises first detector means for detecting a first type of fire signature; the first detector means outputs a first signal indicative of a first detected fire signature. A second detector means is provided for detecting a second type of fire signature; the second detector means outputs a second signal indicative of a second detected fire signature. Signal processing means are provided, for combining the first and second signals. Outputs of the first and second detectors are coupled to the signal processing means; the signal processing means compares the first and second signals to a first predetermined reference value, and outputs a fire condition signal if a combination of the first and second signals exceeds the first predetermined reference value. The signal processing means can include means for multiplying the first and second signals, and then outputs a fire condition signal if a product of the first and second signals exceeds the first predetermined reference value.

An alternative embodiment of the invention may utilize a signal processing means which includes means for adding the first and second signals, such that the signal processing means outputs a fire condition signal if a sum of the first and second signals exceeds the first predetermined reference value.

The signal processing means can include means for comparing the product of the first and second signals to the first predetermined reference value, and also include means for comparing, if the product is below the first predetermined value, each of the first and second signals to second and third predetermined values, respectively. The signal processing means will then indicate a fire condition if one of the first and second signals exceeds one of the second and third predetermined reference values.

The first and second detector means can detect combinations of particulates, gases, temperature, particulate size distributions, etc. The specific particulates and gases detected can be smoke, carbon monoxide, carbon dioxide, hydrochloric acid, oxidizable gas, nitrogen oxides, etc.

In addition to the apparatus discussed above, the invention includes a method for detecting fires, with the method comprising the steps of providing first and second detector means as discussed above. The next steps would be detecting the first fire signature with the first detector means, and generating the first signal indicative of the first fire signature. The second fire signature would then be detected with the second detector means, with the second detector means outputting the second signal indicative of the second fire signature. The first and second signals are then combined, yielding a combined result. The combined result is then compared to a first predetermined value; if the combined result is below the first predetermined value, the first signal is compared to a second predetermined value and the second signal is compared to a third predetermined value. A fire condition is then indicated if the combined result exceeds the first predetermined value, if the first signal exceeds the second predetermined value, or the second signal exceeds the third predetermined value.

The signal processing means of the above-discussed embodiments can include means for multiplying each of the first and second signals by a predetermined weighting coefficient prior to adding the first and second signals. This weighting coefficient yields weighted first and second signals, and the signal processing means is configured to output a fire condition signal if a sum of the weighted first and second signals exceeds the predetermined value. The signal processing means can also include a baseline determining means for determining a baseline for at least one of the first signal and the second signal. The baseline value is based upon either a running average of the first or second signal or a rate of change of the one of the first and second signals over time.

BRIEF DESCRIPTION OF THE DRAWINGS

The above and other objects and the attendant advantages of the present invention will become readily apparent by reference to the following detailed description when considered in conjunction with the accompanying drawings, wherein.

DETAILED DESCRIPTION OF THE PREFERRED EMBODIMENTS

In developing the present invention, a number of preliminary tests were conducted in order to determine the characteristics of a number of different fire signature detectors in a controlled environment.

Figure 2:
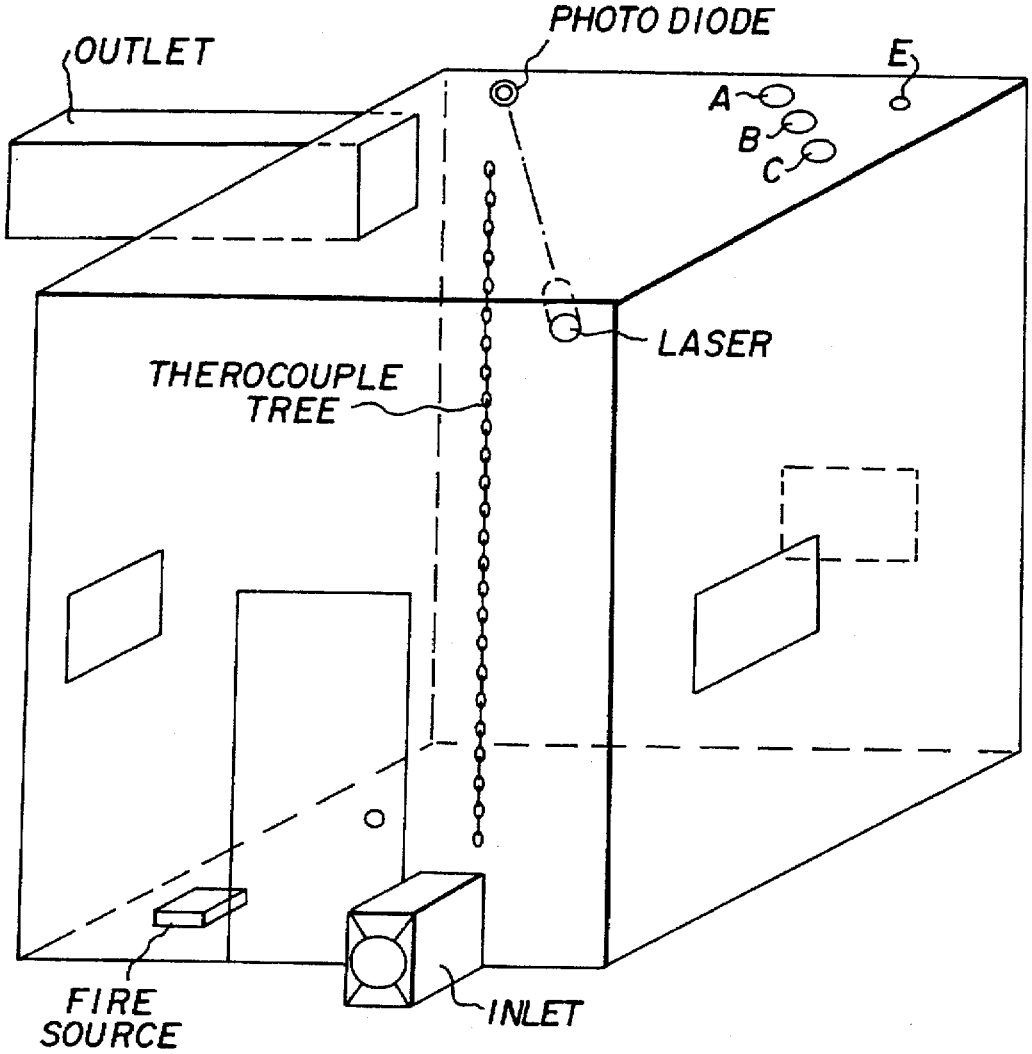
FIG. 2 illustrates a test environment having an embodiment of the invention disposed therein.

The tests were performed in a 2.8×2.8×3.7 m (9.25 ×9.25×12 ft) room (1027 $ft^3$). The walls were constructed of two layers of 0.5 inch gypsum board. All seams were taped and spackled, and the interior was painted. FIG. 2 shows a schematic of the test compartment. There were three viewing windows, one in the left wall, front side, one in the back wall right corner, and a third one in the right wall. A standard door was centered on the front wall. Ventilation was provided through a 38 cm×30 cm duct located at the floor in the front right corner of the room. The room was exhausted with a 0.9 $m^3/s$ (2000 cfm) fan which is ducted into the back left corner of the room.

The experiments are divided into two test series. The first series consisted of multiple tests with each of the fuel sources. Each test consisted of initiating the test source with the compartment closed except for the inlet duct (see FIG. 2). This setup constituted quiescent conditions in the test room. The second test series consisted of the same sources initiated under a stirred atmosphere condition. This condition was created with the use of a small 15 cm (6 inch) fan in the inlet duct blowing into the test compartment.

Figure 3:
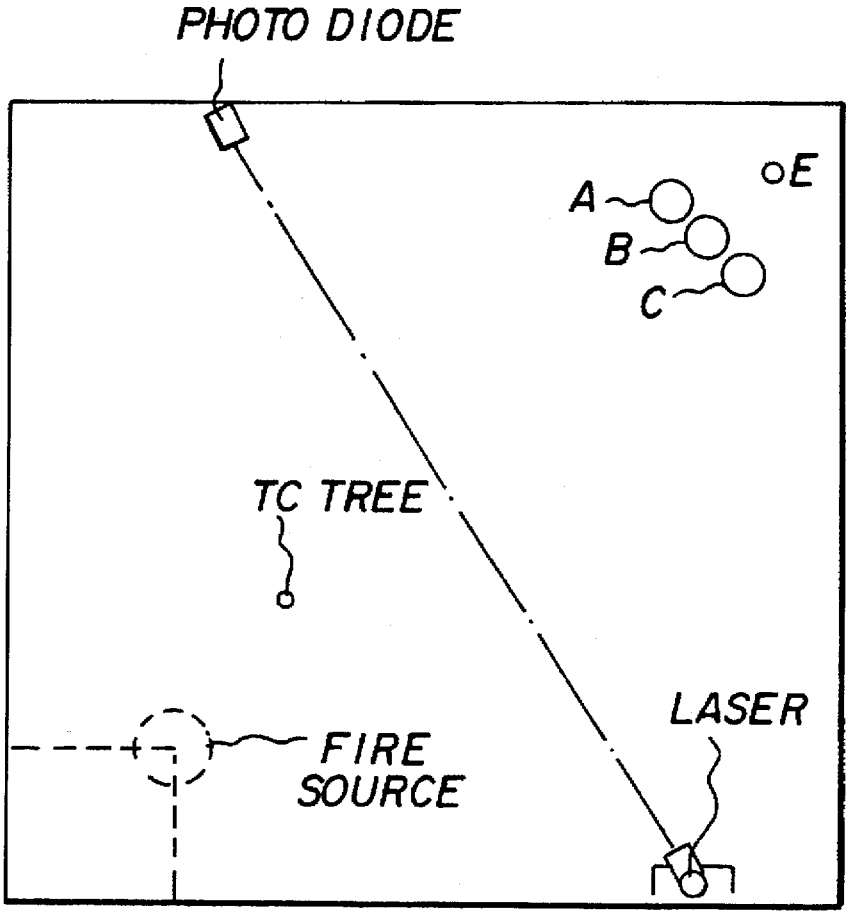
FIG. 3 illustrates an alternative view of the test environment.

FIG. 3 shows the instrument layout on the ceiling of the test compartment. Smoke obscuration was measured using (1) a Simplex (™) ionization detector (Model 4098-9761), (2) a Simplex photoelectric detector (Model 4098-9701), and (3) a diode laser with photodiode setup. Temperature in the compartment was measured with (1) a Simplex heat detector (model 4098-9731), (2) a type-T thermocouple, and (3) a tree of 10 type-K thermocouples. Carbon monoxide concentrations were measured using standard gas sampling techniques as described below.

Most single station commercially available smoke detectors are designed as closed units in which smoke obscuration is signaled as either an alarm or no alarm condition. It was desired to use available detectors which could provide a signal proportional to the level of smoke obscuration in the test space. This resulted in the use of Simplex detectors which are designed as part of an integrated fire detection system. These detectors are typically used in commercial and public buildings and represent costlier detectors than normally found in residential structures. As such, it is believed that these detectors may have been more rugged and less prone to false alarms than many single station detectors. Manufacturer experience indicated the same.

The Simplex detectors were supplied with a specifically designed hardware/software package which is normally used for UL(™) testing. This package (UL Tester) polled the detectors every 4 to 5 seconds and saved the data to a computer file. Due to proprietary constraints, the design of these detectors precludes obtaining a measurement from the detectors without the UL Tester. The output from the UL tester is provided as a percent obscuration per unit length based on a standard smoke used by UL in evaluating smoke detectors. Thus, although the smoke detectors do not measure the attenuation of light by smoke directly, the output is represented as equivalent smoke obscuration (%/meter) based on the UL standard smoke. The third smoke measurement device consisted of a 5 mW laser with a 670 nm wavelength (Meredith Instruments (™)) and a photodiode receiver. The percent transmission of light was measured over a pathlength of 282 cm (9.25 ft).

The tree of 10 type-K thermocouples extended from the ceiling to the floor near the center of the room. Thermocouples were placed 30 cm (12 inches) apart, starting 61 cm (24 inches) above the floor. The type-T thermocouple was made of 36 awg wire with a 0.005 inch bead and was located next to the Simplex heat detector. This fine gauge thermocouple was selected to assess if a faster response afforded an enhanced capability to detect a fire compared to the Type-K 24 awg thermocouples.

Gas analysis consisted of CO, $CO_2$ and $O_2$ concentrations. Carbon monoxide was measured with a Beckman (™) 880A NDIR analyzer using a 500 ppm range with a ±1% full scale accuracy. Carbon dioxide was measured with a Horiba (™) VIA-510 NDIR analyzer using a 1 percent range with a ±0.5% full scale accuracy. The oxygen concentration was measured with a Servomex (™) 540A analyzer using a 0 to 25 percent range with a ±1% full scale accuracy. The gas sampling probe consisted of a 6 mm (0.25 inch) diameter copper tube extending 7.6 cm (3 inches) below the ceiling. The 90 percent response times for the gas sampling system were measured to be 13, 17, and 15 seconds for the CO, $CO_2$ and $O_2$ analyzers, respectively.

The output from all instrumentation except the Simplex detectors was recorded at 1 second intervals using a PC computer and LABTECH(™) Notebook data acquisition software. Data reduction was performed with standard spreadsheet software.

Detailed descriptions of each source are presented below. Unless specified otherwise, the test sources were placed 61 cm (24 inches) from each wall in the front left corner of the compartment and approximately 10 cm (4 inches) above the floor. This location was chosen to separate the test source and the detectors as much as possible while not placing the source in front of the inlet duct. In all cases, the source was started at 100 seconds from the start of data collection. The first 100 seconds of data collection were used to establish a baseline for each measurement.

The hot plate used for smoldering sources was a Thermolyne (™) HP46825 1100 W unit with a 19 cm (7.5 inch) square surface. Samples were placed on a 0.6 cm (0.25 inch) aluminum plate which is on top of the hot plate. A type K thermocouple, inserted into the side of the aluminum plate, monitored the temperature throughout the test.

Cigarettes

Four Marlboro (™) cigarettes were mounted horizontally approximately 2 cm on center from a ring stand assembly. The stand was positioned underneath the detectors so that the cigarettes were 51 cm (20 inches) from the walls and 168 cm (66 inches) above the floor. Tests were also conducted with the cigarettes in the front left corner of the compartment, positioned 147 cm (58 inches) above the floor and 30 cm (12 inches) from the walls.

Candles

Six 5 cm high, 4 cm diameter candles were placed in the standard location. The candles were ignited with a match starting at 100 seconds after the start of data collection. Tests were also conducted with the candles positioned at the same height but centered underneath the detectors.

Automotive Exhaust

The exhaust from a 1986 Ford (™) pickup truck having an internal combustion engine was piped into the compartment through 7.6 cm (3 inch) diameter aluminum duct. The open end of the duct was positioned 61 cm from the walls and 20 cm above the floor so that the exhaust vented upward.

Aerosol

An aerosol can of hair spray was sprayed approximately 61 cm (2 ft) below the detectors. Other tests consisted of air freshener sprayed from the front left corner of the compartment. These tests proved less effective in causing a false alarm condition.

Cooking Fumes

Cooking fumes were produced by heating vegetable oil in a pot placed on top of the hot plate. The pot with a base diameter of 16.5 cm was filled to a depth of 2 cm with oil. A Type K thermocouple was placed in the oil to monitor the temperature throughout the test. Data collection started at the moment the hot plate was turned on. The hot plate was initially set to its maximum setting and then turned down to half power when the oil temperature reached a value of 500K. The resulting vapor from this procedure appeared representative of a typical cooking event.

A second cooking scenario consisted of cooking 5 strips of bacon in a 25 cm (10 inch) skillet located under the detectors, 51 cm (20 inches) from the walls and 132 cm (52 inches) above the floor. The skillet was heated with a propane gas burner for one test and on the hotplate for a second test scenario. The propane gas burner was a source of CO when the skillet was placed on it. This was due to flame quenching at the pan surface. Without the skillet the burner produced no measurable CO. ps Dust Dust was generated using a 10 gallon wet/dry vacuum quarter-filled with a fine gray concrete powder. The dust was vertically propelled out of the exhaust port. The vacuum was placed in the standard location.

Smoldering Wood

Modeled after UL Standard No. 268, ponderosa pine sticks were heated on a hot plate to produce a smoldering source. The stick size was 7.6×2.5×1.9 cm (3×1×0.75 inch). The hot plate was preheated outside of the compartment to a temperature of 400° C. (673K) and placed in the standard position just prior to 100 seconds. The plate was heated outside of the compartment to avoid any effects of the thermal plume. At 100 seconds, eight sticks were placed (wide side down) in a spoke-like pattern on the hot plate.

Cotton Wick

Similar to EN54, cotton wick (No. 1115, Pepperell Braiding Co. (™tm)) was used to produce a smoldering source. Twenty pieces of 13 cm (5 inch) long cotton wick were hung from a ring stand so that the wicks were adjacent to one another. The stand was positioned so that the end of the wicks were at the standard source location. The wicks were ignited using a match and blown out immediately upon ignition, leaving them to smolder.

PVC-insulated Cable

Electrical cable with a polyvinylchloride (PVC) covering (Granger (™) 18/3 SJT) was placed on the hot plate to produce a smoldering source. Six pieces of 15 cm 6 inch) long cable were spaced about 2 cm apart on top of the hot plate. The hot plate was preheated outside of the compartment to 400° C. and positioned in the standard source location just prior to placing the cable on it at 100 seconds.

Polyurethane Foam

Three pieces of 13×13×2.5 cm (5×5×1 inch) polyurethane foam were stacked to form a 7.5 cm high pile. The foam had a density of 18.4 kg/m$^3$ (1.15 lb/ft$^3$) and was not fire resistant. At 100 seconds after the start of data collection, a match was used to ignite a corner of the bottom piece of foam.

Heptane

A liquid fire was produced from burning 100 mL of heptane in a 10×10×2.2 cm (4×4×0.88 inch) steel pan. Just prior to ignition the fuel was poured in the pan on top of a 20 mL water substrate. Ignition was with a match.

Shredded Paper

This source was modeled after the paper fire (Test A) as specified in UL 268. Newsprint (black only) was shredded into strips approximately 8 cm long and 0.6 cm wide. Original tests consisted of 1.2 ounces of shredded newsprint poured into a vertical 10 cm diameter metal tube, 30.5 cm long (a 7.6 cm dia tube was also used). With the bottom temporarily capped, the fuel was tampered down so that the top of the paper was 10 cm below the top of the tube. A hole about 2.5 cm in diameter was then formed down through the center of the paper. The temporary cap was then removed. The paper was ignited with a match at the bottom center of the tube. This setup produced a large volume of smoke for the first 70 seconds and then transitioned to a flaming fire for about 20 seconds. Due to a large volume of smoke the smoke detectors became saturated once the plume came in contact with the detectors. This was true even for the smaller tube. Additional tests were conducted with 1 ounce of shredded paper in a 10 quart pail. The paper was ignited with a match resulting in a flaming fire.

Fabric

Two different types of fabric were tested, poly/cotton and cotton fabric. Each was burned as a 25 by 64 cm (10 by 25 inch) strip hung with the 64 cm long side in the horizontal direction. The fabric was ignited with a match at one of the bottom corners.

RESULTS

Figure 8:
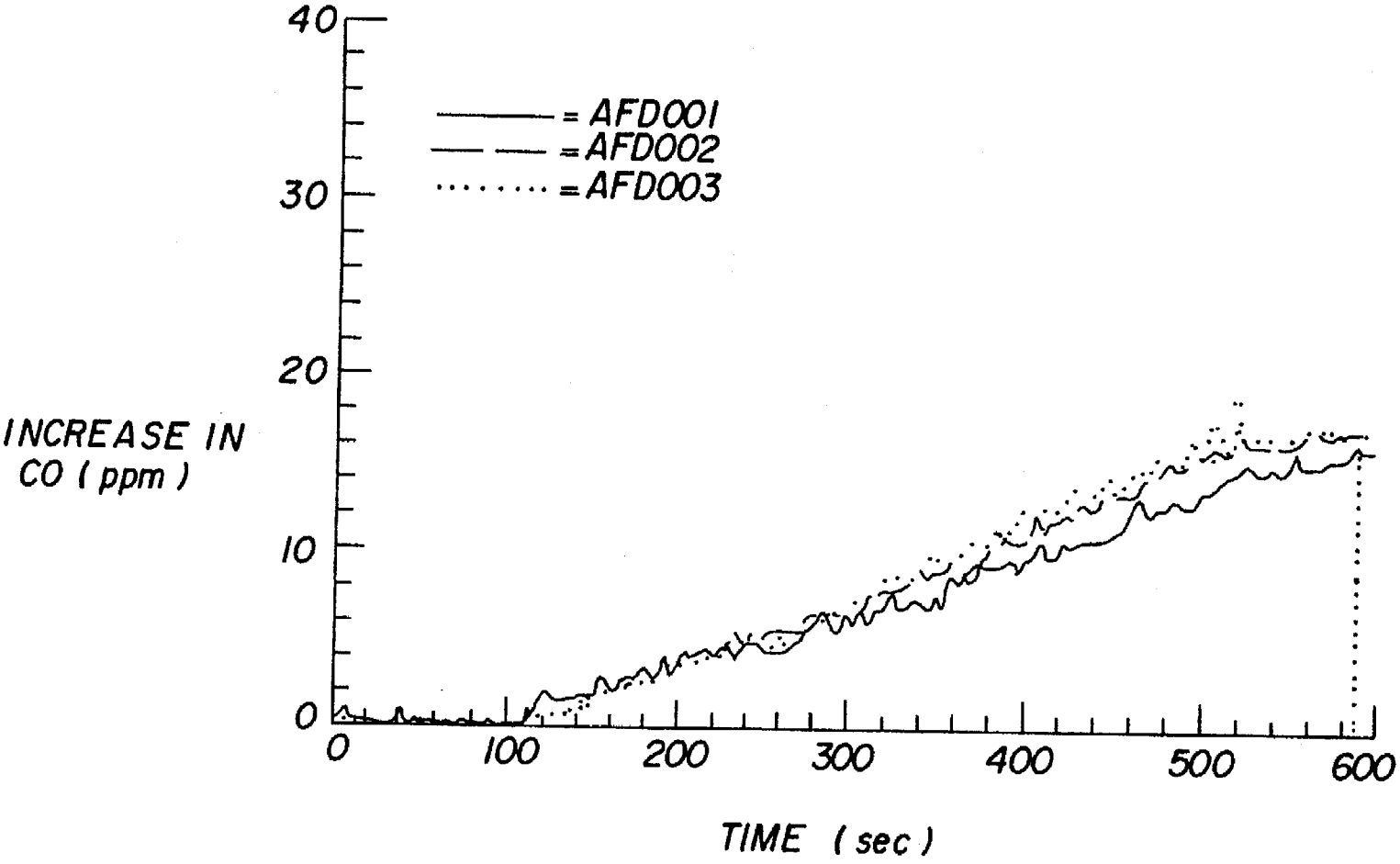
FIG. 8 illustrates a change in CO concentration with respect to ambient conditions for a number of heptane tests.
Figure 9:
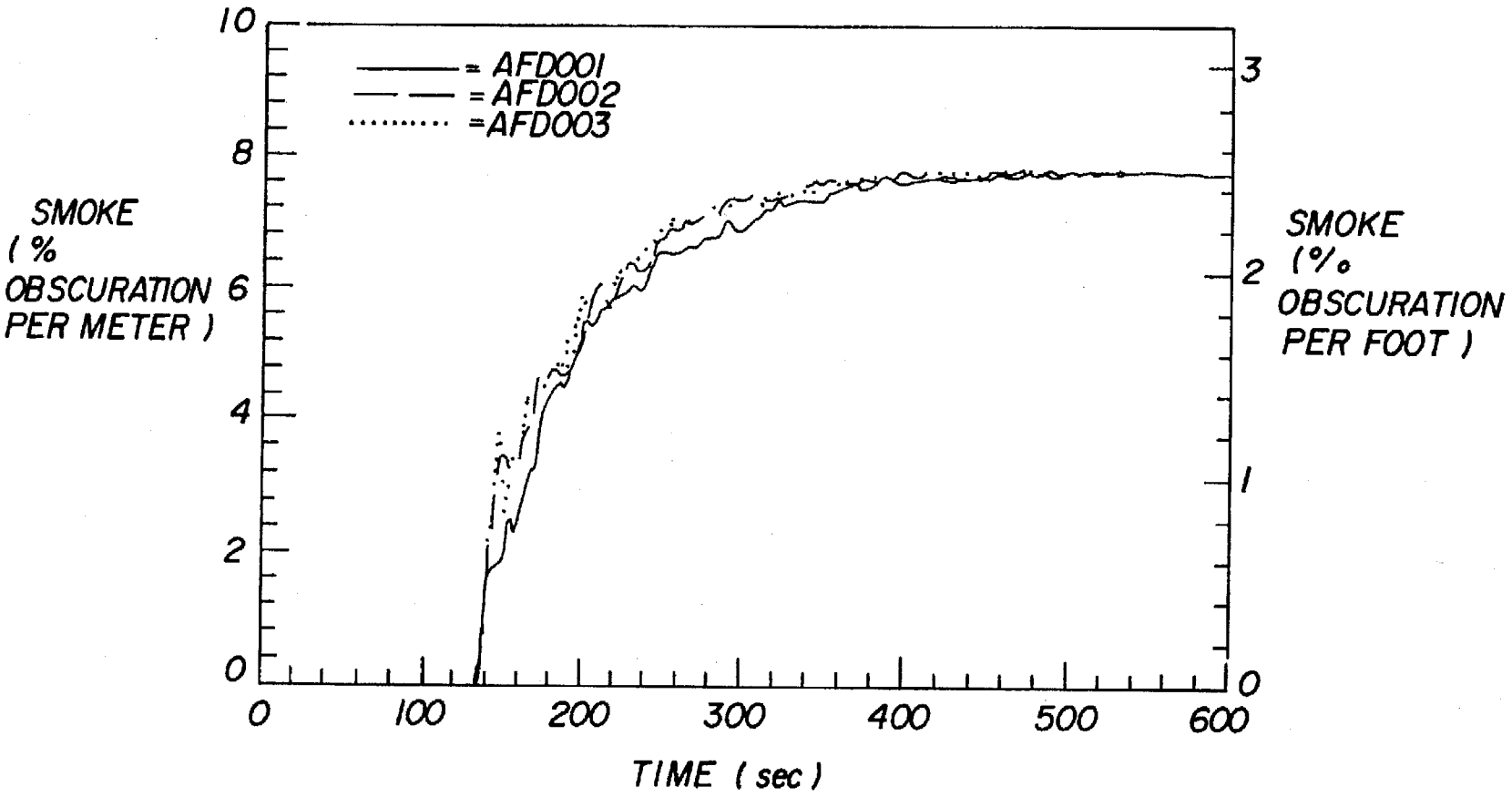
FIG. 9 illustrates smoke as measured by an ionization detector.
Figure 10:
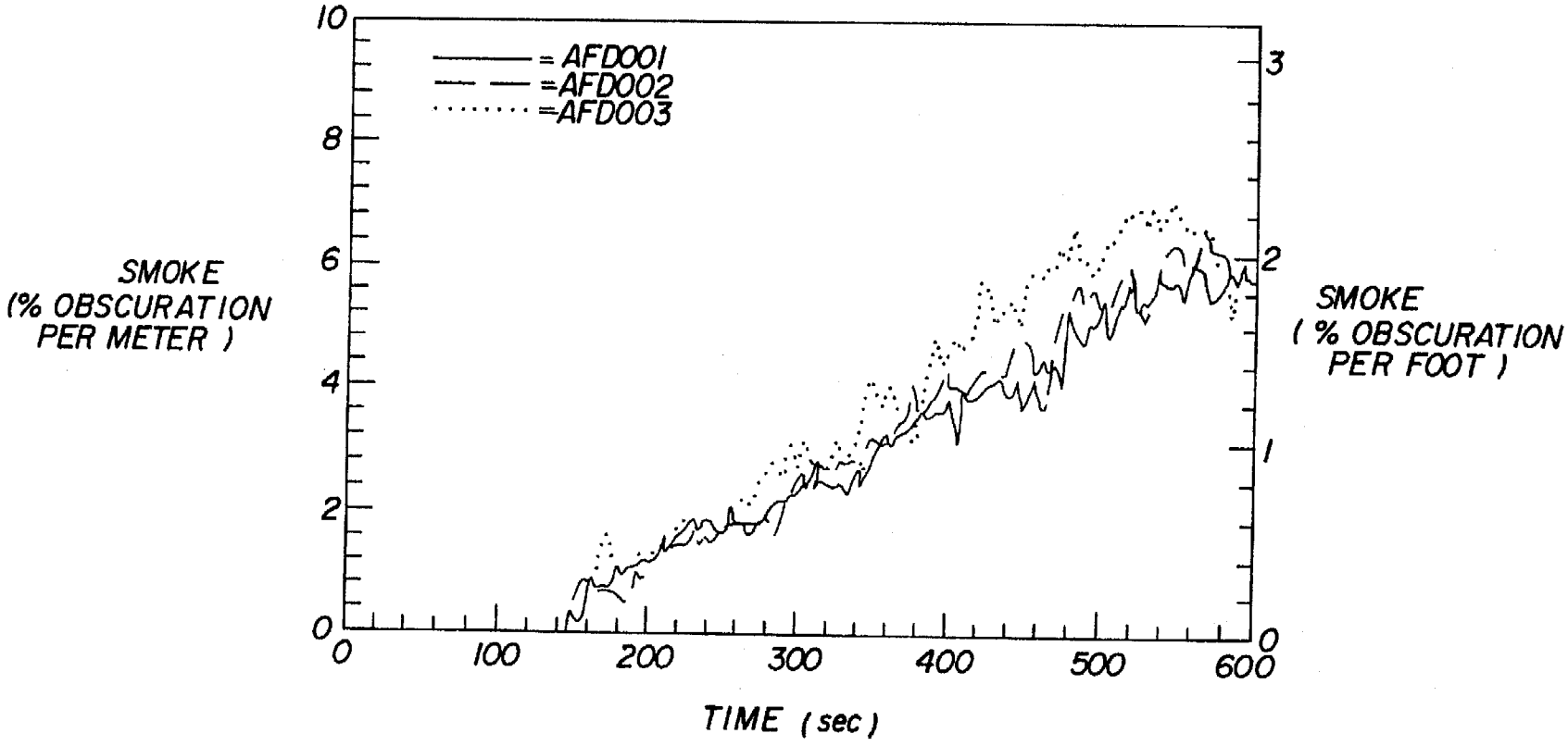
FIG. 10 illustrates smoke as measured by the photoelectric detector.

Tests were performed in triplicate for most sources to assess the reproducibility of the measurements. In general, the tests were quite reproducible as can be seen in FIGS. 8 to 10 which show selected measurements for heptane pool fires. FIG. 8 shows the change in CO concentration with respect to ambient conditions versus time for each of three heptane tests. The rise in CO is virtually identical, leveling off to a value of about 16 ppm. FIGS. 9 and 10 show the smoke as measured by the ionization and photoelectric detectors, respectively. Again, the data agree quite well for all three tests. It should be noted that the value of 7.7 percent obscuration per meter (2.4 percent per foot) reached by the ionization detector was the maximum measurable limit for the detector. Identical heptane tests were also performed with and without the gas sample system on. These tests showed that there was no effect of the gas sample probe being located near the smoke detectors.

Creating non-fire threat sources which caused the smoke detectors to reach alarm levels proved to be more difficult than expected. This is believed to be partly a result of the Simplex detectors which compared to some less expensive single station units have unique design mechanisms aimed at eliminating false alarms. A false alarm was considered to be a smoke detector output corresponding to 4.8 percent obscuration per meter (1.5% per ft) for a nuisance alarm source. The level of 4.8 was chosen as a representative value at which the ionization and photoelectric detectors could be compared on an equivalent basis to the alarm criteria discussed below. Of the nuisance alarm sources, the ionization detector only alarmed for cigarettes underneath the detectors with quiescent conditions and frying bacon on the gas burner. Alarm conditions for other sources would not have been reached even for a smoke detection threshold of 3.2 percent obscuration per meter (1.0% per ft). The photoelectric detector alarmed for most of the sources, except the car exhaust and candles. Attempts were made to create non-fire threat sources of steam by boiling large pots of water. However, even with increases in relative humidity from 16 to 82 percent in the compartment, the photoelectric detector failed to respond and the ionization detector reached sporadic peaks of only 1.3 percent obscuration per meter (0.4% per foot). The dry winter conditions may have contributed to the difficulty of obtaining false alarm levels.

Although not fully achieved in these experiments, it is known that cooking events and steam are the major sources of false alarms for residential smoke detectors. A standardized test of a common false alarm source is needed in order to fully compare the performance of current detectors and to evaluate improved performance of new fire detection technology. This cannot replace field testing, however it would provide a benchmark for comparison of the false alarm susceptibility of detectors. The UL 268 standard specifies three tests utilizing non-fire threat sources: (1) a Humidity Test, (2) a Dust Test, and (3) a Paint Loading Test. These tests are primarily designed to determine the change in sensitivity of a detector after exposure to the source. As such, these tests do not address the level of a source that causes a false alarm or the time to which a detector will alarm due to a non-fire threat source. In other words the tests fail to establish a baseline for comparison which assesses a detector's susceptibility to false alarm.

In general, conducting tests under stirred conditions provided little insight with respect to detector sensitivities. These conditions primarily resulted in the sources (fire threat and non-fire threat) being harder to detect due to greater dilution. This was true for both CO and smoke detection.

As expected, the ionization detector was more sensitive than the photoelectric detector to the flaming sources. However, the opposite was not always true for smoldering sources. Table 1 illustrates this point by showing the elapsed time from ignition at which the ionization and photoelectric detectors reached a value of 4.8 percent obscuration per meter (1.5% per ft) for fire sources. As can be seen, the ionization detector responded earlier for all flaming sources. The ionization detector also responded sooner than the photoelectric detector for two of the four smoldering fire threat sources. It is interesting to note that the ionization detector also alarmed much sooner for cigarette smoke and frying bacon on the gas burner, as seen in tables 5 and 6. In general though, the photoelectric detector was more prone to false alarms. The ionization detector produced negligible responses to hair spray, dust, and cooking oil, whereas values greater than 6.4 percent obscuration per meter (2% per ft) were observed for the photoelectric detector.

Table 2 presents data for the initial response time for the smoke and CO detectors for representative fire threat sources. Listed in the table is the time from ignition at which the detector started to respond. Although the time to an alarm condition is of greater importance, this comparison indicates the relative response capabilities of the different detectors while avoiding the uncertainty associated with selecting appropriate alarm levels. For all fire sources, the ionization detector started to respond before or at the same time as the photoelectric detector. However as seen in Table 1, the photoelectric detector reached alarm conditions sooner in the case of smoldering wood and PVC cable. As can be seen in Table 2 for all sources, the CO detector responded faster than either the ionization or photoelectric detectors. Response times for the smoke detectors were 30 to 300 percent longer. These results indicate that the use of a CO detector could significantly shorten the time to alarm for CO producing fire threat sources.

TABLE 1

Time from Ignition at which the Ionization and Photoelectric Detectors Reached a Value of 4.8 percent Obscuration per meter (1.5% per ft)

| Fuel Source | Test No. | Time to Ignition to Alarm(s) Ion Detector | Photoelectric Detector |
|---|---|---|---|
| Smoldering Sources: | | | |
| Wood | 25 | 471 | 151 |
| Wood(s)[1] | 66 | 511 | 168 |
| Cotton Wick | 7 | 484 | 855 |
| Cotton Wick(s) | 37 | —[2] | — |
| PVC-cable | 28 | — | 249 |
| PVC-cable(s) | 49 | — | — |
| Shredded Paper | 17 | 83 | 88 |
| Flaming Sources: | | | |
| Polyurethane | 15 | 45 | 70 |
| Polyurethane(s) | 38 | 45 | 70 |
| Heptane | 3 | 79 | 289 |
| Heptane(s) | 56 | 88 | 289 |
| Shredded Paper | 51 | 37 | — |
| Shredded Paper(s) | 65 | 28 | — |
| Poly/Cotton Fabric | 72 | 54 | 92 |
| Cotton Fabric | 73 | 32 | — |

[1](s) indicates stirred conditions.
[2]—indicates smoke level was not reached.

TABLE 2

Time(s) to Initial Response for the Carbon Monoxide, Ionization, and Photoelectric Detectors for Fire Threat Sources

| Description | Test | CO | Ion | Photoelectric |
|---|---|---|---|---|
| Wood 400° C. | 25 | 46 | 78 | 91 |
| Cotton wick | 7 | 182 | 331 | 365 |
| PVC cable | 28 | NR | 104 | 134 |
| Smoldering paper | 17 | 27 | 79 | 98 |
| Polyurethane | 15 | 28 | 36 | 62 |
| Heptane | 3 | 20 | 37 | 49 |
| Flaming paper | 51 | 17 | 24 | 24 |
| Fabric (poly/cotton) | 72 | 25 | 37 | 37 |
| Fabric (cotton) | 73 | 20 | 28 | 45 |

NR—no response.

Figure 11:
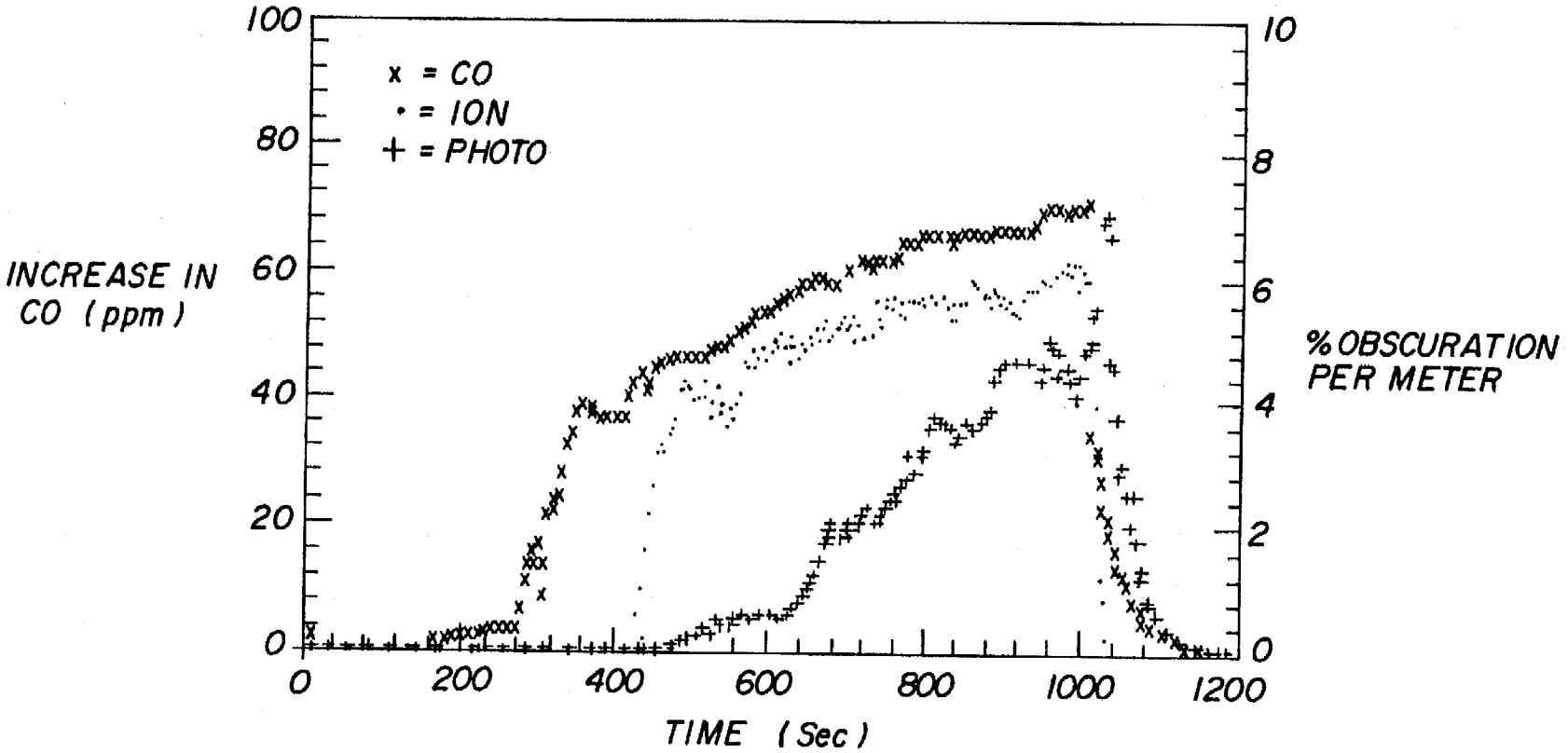
FIG. 11 illustrates results for CO formation and smoke production for a fire threat source.

The advantages of including a CO measurement in an alarm algorithm can be seen in the following two examples. The results for CO formation and smoke production are presented in FIGS. 11 and 12 for a fire threat and non-fire threat source, respectively. FIG. 11 shows the increase in CO concentration and the measured smoke production versus time for 20 pieces of smoldering cotton wick. An increase in CO provides the earliest detection of the smoldering wick. At about 285 seconds the measured carbon monoxide concentration increased quickly to 40 ppm and finally reached a maximum of 70 ppm at the time the wicks were consumed. Although the ionization detector started to respond at 441 seconds, which was more rapid than the initial photoelectric detector response at 465 seconds, it was considerably slower compared to the CO detector.

Figure 12:
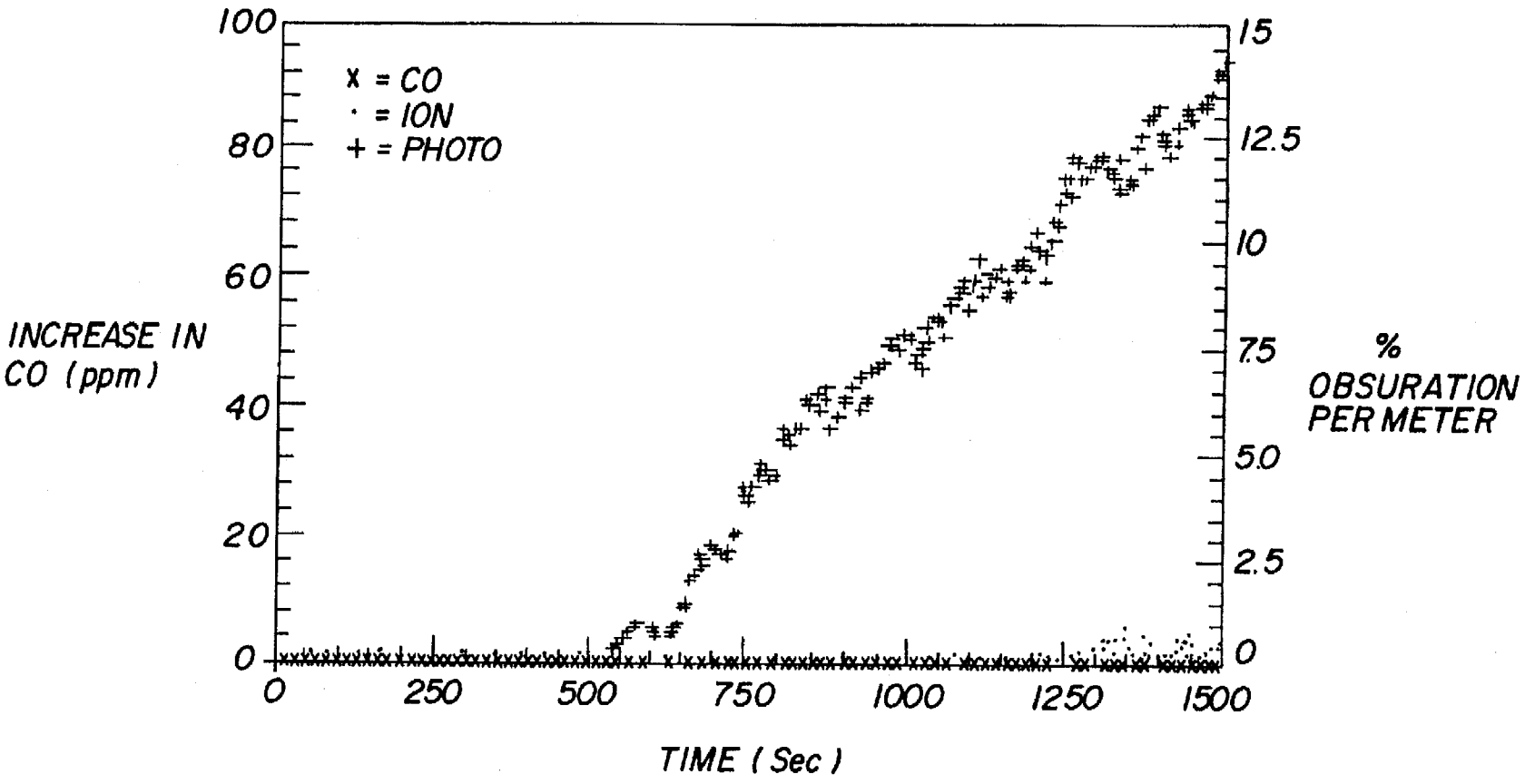
FIG. 12 illustrates results for CO formation and smoke reduction for a non-fire threat source.

Detector responses to a non-fire threat (cooking fumes from heated oil) are shown in FIG. 12. In this case, the photoelectric detector was quite sensitive to the heated oil vapor as evidenced by the steep rise in the detector output. Values as high as 14.5 percent smoke obscuration per meter (4.7% per foot) were reached at the end of the test. The ionization detector showed no significant response over the course of the whole test. Due to the lack of combustion, there was no CO produced.

Figure 13:
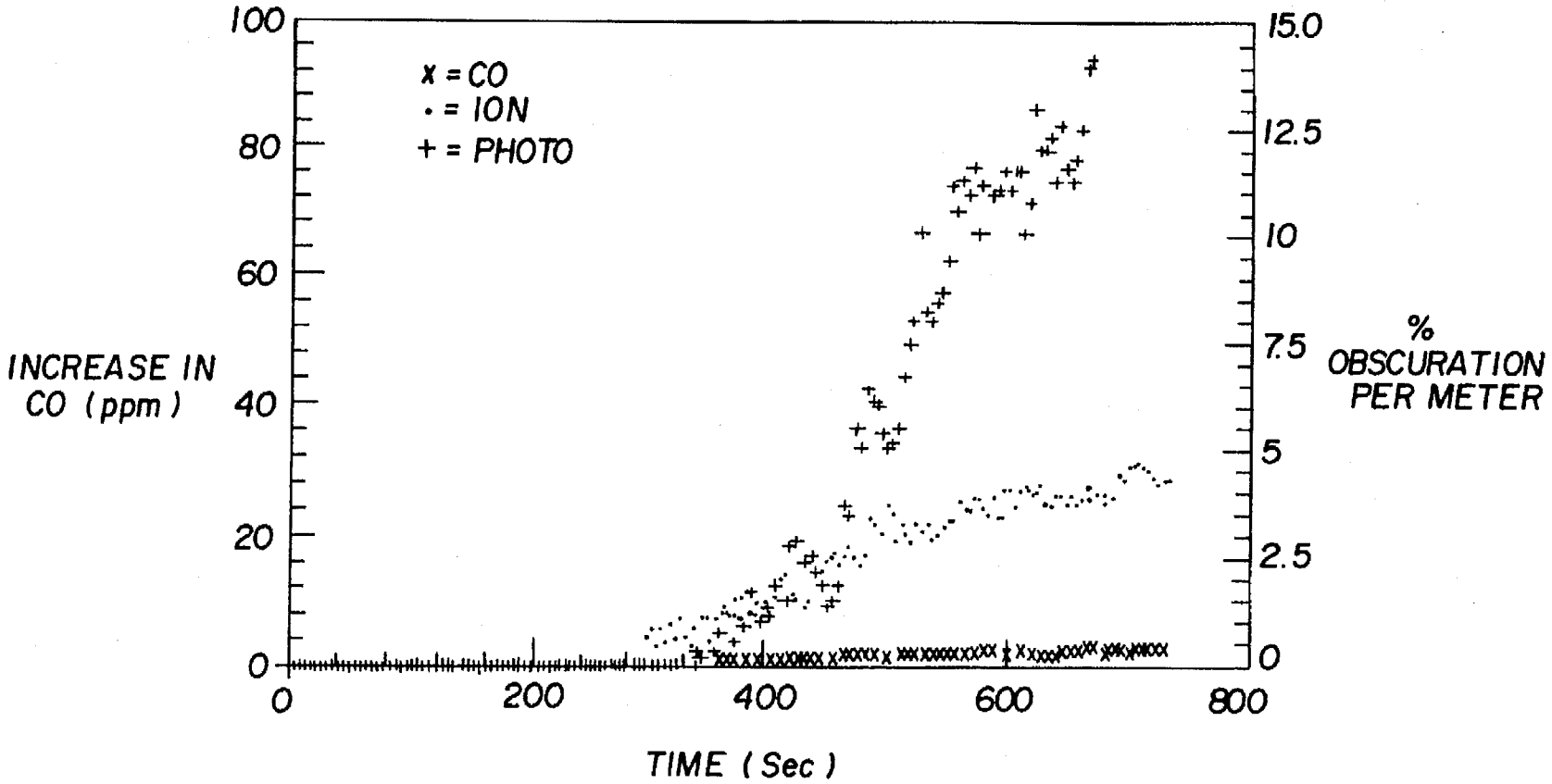
FIG. 13 illustrates an increase in CO concentration and measured smoke production versus time for smoldering PVC insulated cable.

The results from these two sources indicate that the combination of the CO concentration and the ionization detector output provide a good multi-signature technique to detect fire threats and eliminate false alarms. This is in agreement with the findings of Heskestad and Newman. The inclusion of a rise in CO has two advantages. One is that the detection time is shortened and the second is that many false alarms can be avoided as these sources (cooking fumes, shower steam, and dust, for example) do not produce CO. The detection of CO alone, however, is not sufficient since certain potential fire threats do not produce significant levels of CO. For instance, as can be seen in FIG. 13, the smoldering PVC coated cable generated less than a 2 ppm increase in CO even though smoke levels of over 12.5 percent obscuration per meter (4% per ft) were measured using the photoelectric detector. This example points out the need for establishing multi-signature detection techniques using smoke and CO measurements which can distinguish between fire threat and non-fire threat conditions. The present invention is directed to such multi-signature detection techniques.

Figure 14:
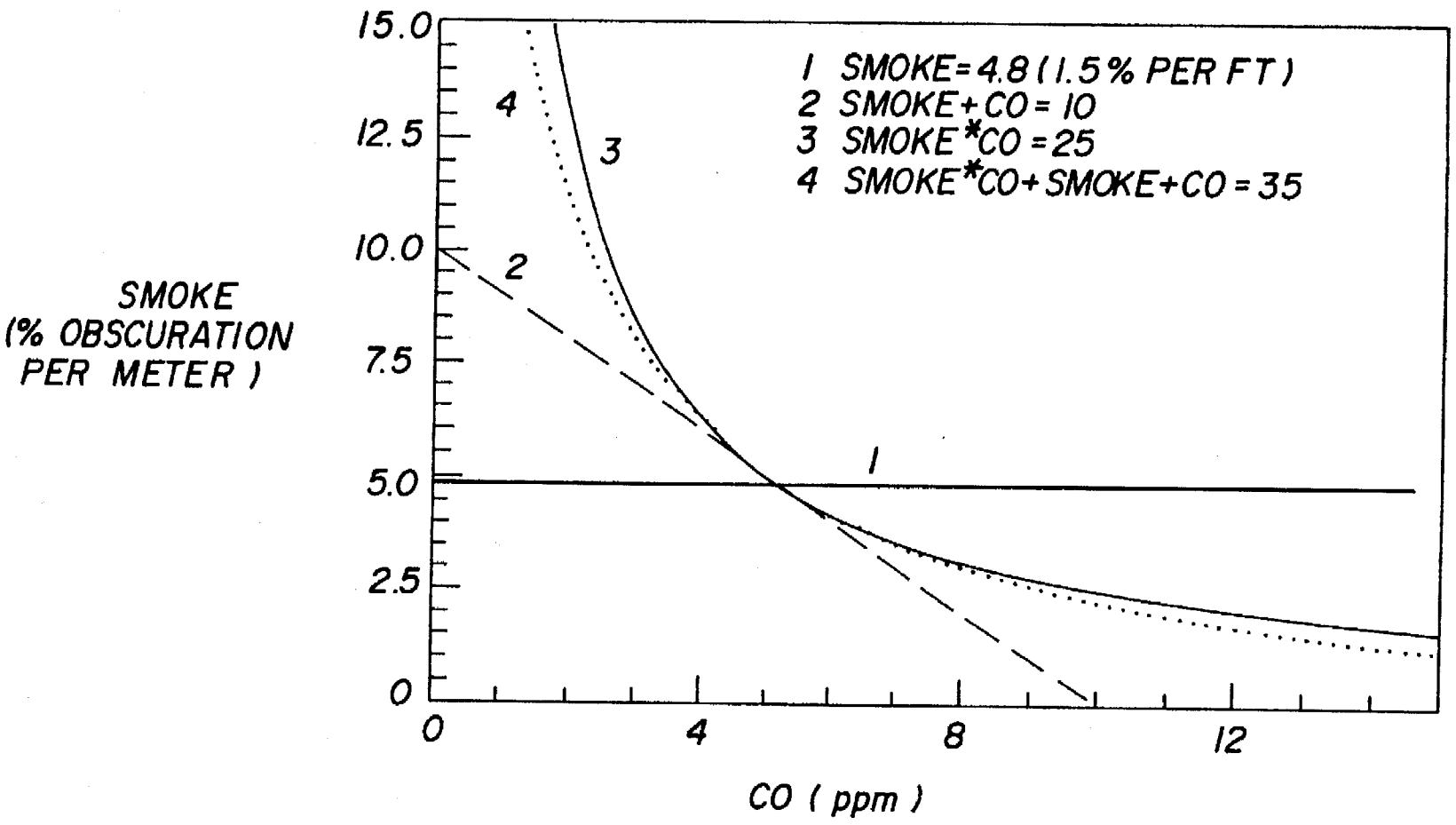
FIG. 14 illustrates a plot of smoke versus CO concentration for a plurality of detection algorithm strategies, as illustrated thereupon.

The results of these tests indicate that the use of a CO measurement can significantly shorten the time to alarm for many fires, and, in conjunction with standard smoke detectors, can reduce false alarms. Toward this end, many multi-signature signal processing algorithms were examined to identify promising detection techniques, in the development of the present invention. Due to time constraints in studying the numerous experiments and possible alarm algorithms, focus was given to identifying simple detection algorithms which provided the appropriate trends (i.e., quicker fire detection and fewer false alarms). The approach taken is depicted in FIG. 14 which shows a plot of smoke obscuration versus CO concentration. This plot illustrates several multi-signature detection algorithm strategies. Line 1 represents the alarm of a smoke detector set to 4.8 percent obscuration per meter (1.5% per ft). Sources which produce detector outputs lower than this value are considered nuisance alarm sources.

Curve 2 represents the use of "AND/OR" logic by requiring that the sum of the smoke measurement AND the CO concentration OR the smoke measurement OR the CO concentration reach a preset value. For this example the alarm value is 10 (i.e., Smoke +CO=10) and the smoke is measured in percent obscuration per meter and the CO concentration is measured as parts per million (ppm). Compared to curve 1, curve 2 effectively reduces the sensitivity of the smoke detector when considered individually. The required smoke level for alarm is 10 instead of 4.8. Reducing detector sensitivity has been a common method for reducing false alarms [4]. However, the reduced sensitivity can also result in much longer response times for real fires. Since fire growth is exponential, longer response times can translate into fire deaths. The inclusion in the algorithm of a change in the CO level serves to reduce this response time effect while maintaining the original objective of reducing false alarms. For example, in order to have an alarm with a smoke measurement of 5 percent per meter, the measured increase in CO would have to be 5 ppm. Since most false alarm sources do not produce CO, the multi-signature detection algorithm eliminates smoke producing nuisance alarm sources that fall below curve 2 in FIG. 14. This type of detection algorithm can also provide faster alarm responses for fire threats in which CO is detected much faster than smoke, such as the smoldering wick test shown in FIG. 11.

Figure 1:
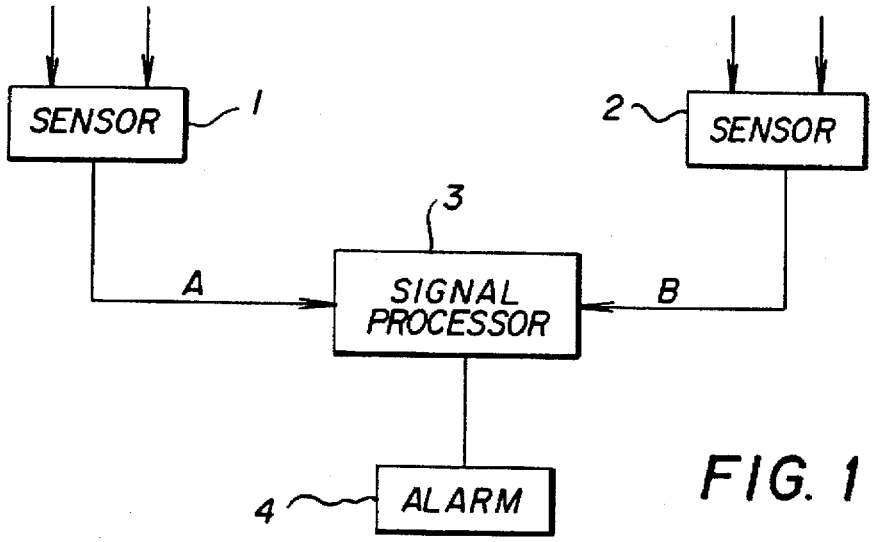
FIG. 1 schematically illustrates an embodiment of the present invention.
Figure 4:
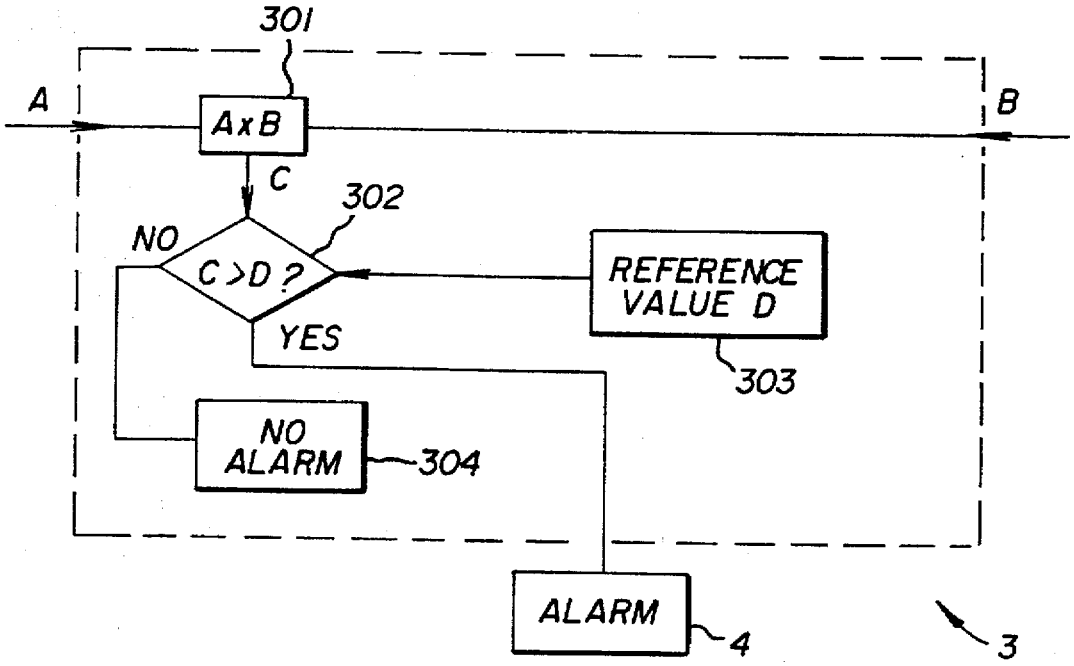
FIG. 4 illustrates an embodiment of the signal processing means of the present invention.

A general embodiment of the invention is illustrated in FIGS. 1 and 4. Detector 1 and detector 2 can be, for example, a smoke detector and a CO detector, respectively. The outputs Of these detectors are fed to signal processor 3 which could be, for example, a CPU. The signal processor combines the first and second signals, and compares the first and second signals, to a first predetermined reference value stored in memory 303. If the signal processor determines that the combination of these signals exceeds the predetermined reference value, a signal is sent to alarm 4 to indicate that a fire condition exists. FIG. 4 illustrates a more detailed view of one embodiment of signal processor 3. Output signals A and B of detectors 1 and 2, respectively, are input to multiplier 301. Multiplier 301 multiplies signal A×B, generating output C. Output C is fed to comparing device 302, which compares the value of output C to a reference value D stored in memory 303. If comparing device 302 determines that output C exceeds reference value D, a signal is sent to alarm 4, indicating a fire condition. If output C is not greater than reference value D, a "no alarm" signal is generated. If the performance of the apparatus is being recorded or monitored, the no alarm signal could be stored in memory 304. In FIG. 14, curve 3 represents the product as a constant value of 25. For clarity the curves in FIG. 14 have been arbitrarily drawn with a common point of tangency. Due to the asymptotic nature of this curve, a non-zero value for both smoke obscuration and the change in CO concentration is required to signal an alarm for this detection algorithm. This characteristic is not always desirable since there are fire sources which can produce near zero changes in the measured CO concentration (eg., smoldering PVC cable). Therefore, in actual practice, this algorithm would preferably be combined with an alarm limit for both smoke and CO. As an illustration, an alarm condition would exist for a product greater than 25 or if the change in CO was greater than 20 ppm or the smoke level was greater than 10 percent per meter. Such an embodiment will be discussed later.

Figure 5:
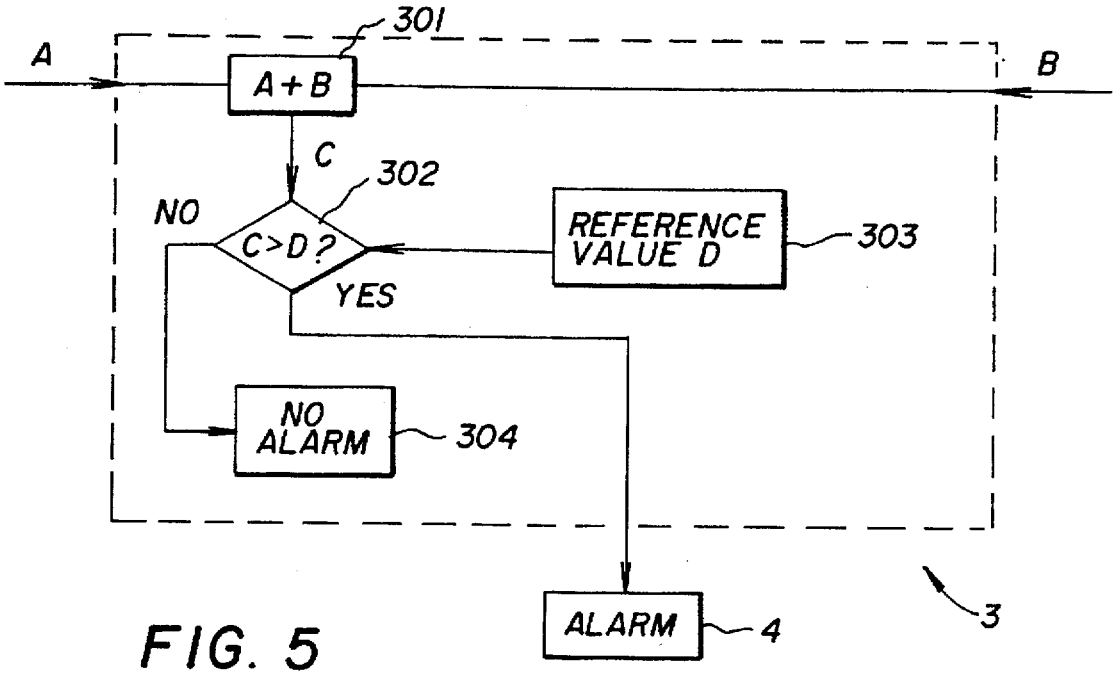
FIG. 5 illustrates an alternative embodiment of the signal processing means of the present invention.
Figure 6:
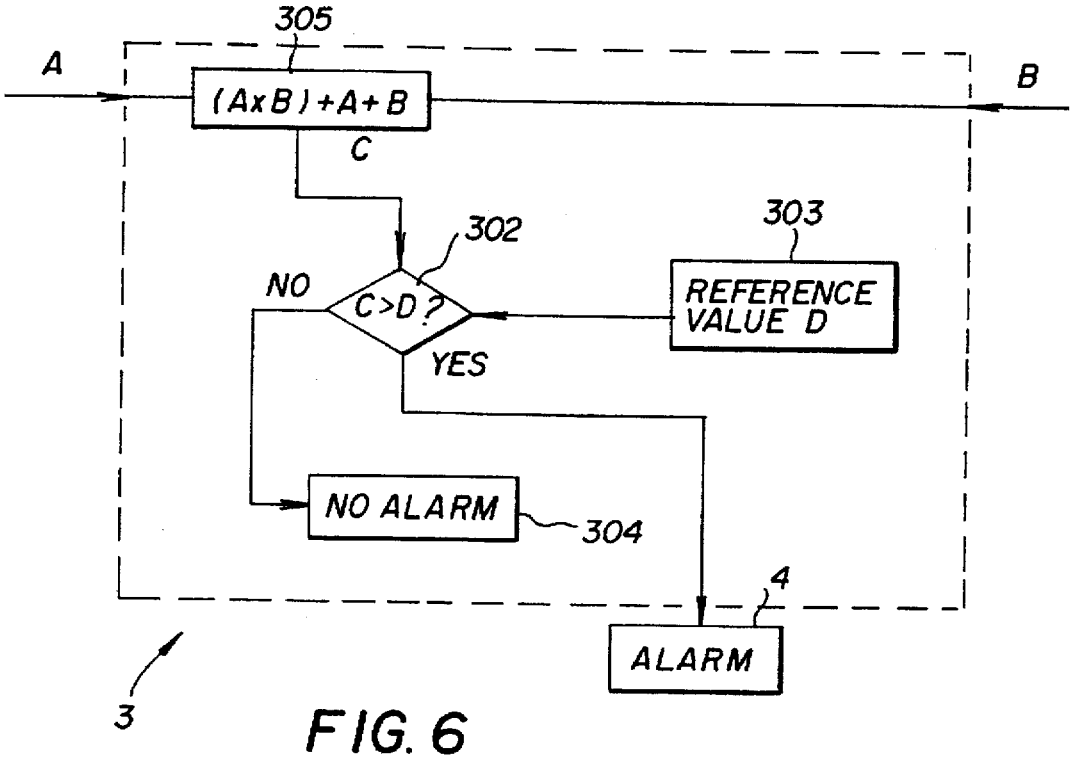
FIG. 6 illustrates an alternative embodiment of the signal processing means of the present invention.
Figure 7:
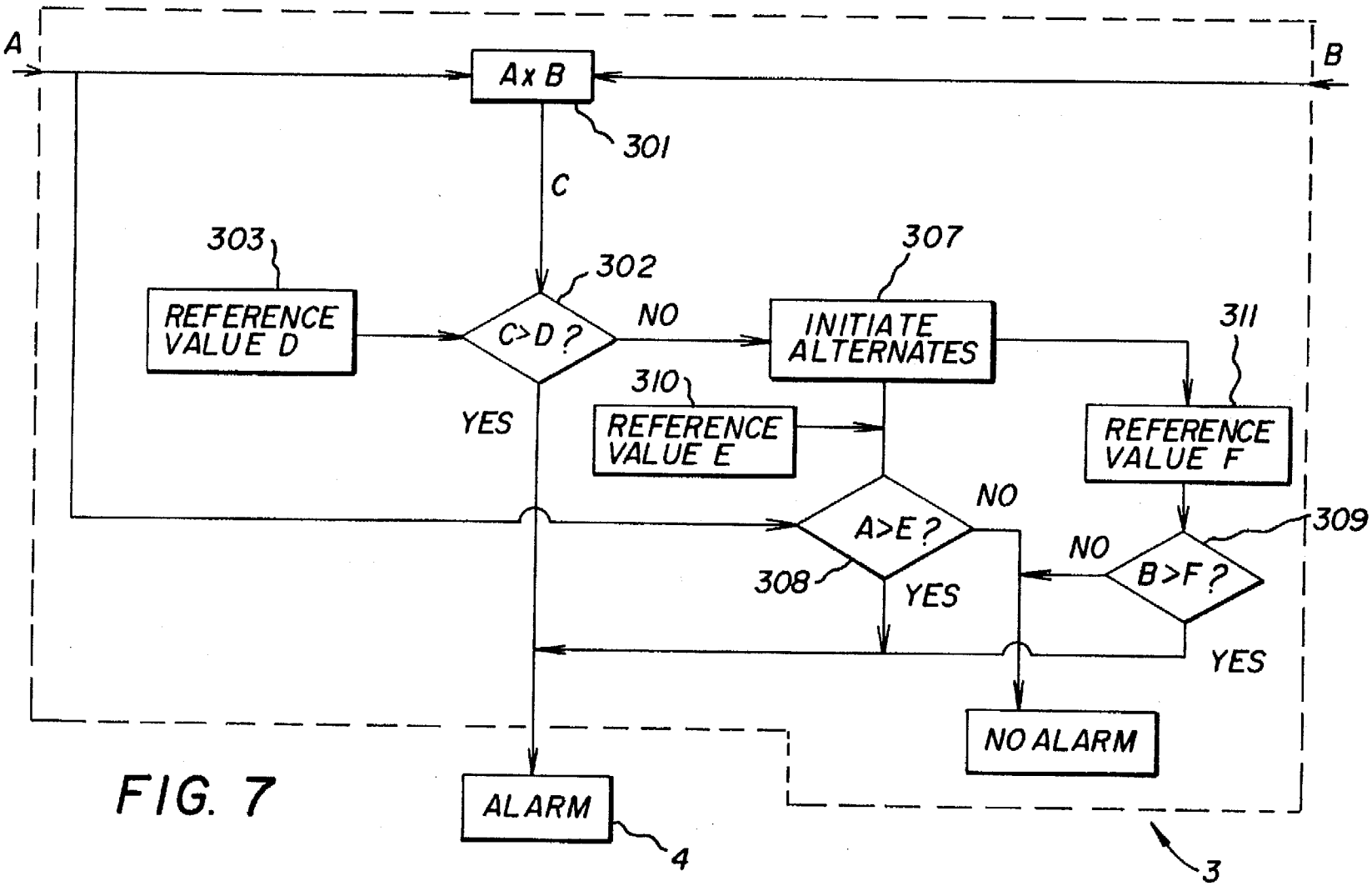
FIG. 7 illustrates an alternative embodiment of the signal processing means of the present invention.

A yet further alternative embodiment of the signal processing means is illustrated in FIG. 5, wherein multiplication device 301 is replaced by addition device 306. In this embodiment, output signals A and B are added, and output from addition device 306 as output C. Output C is then compared to reference value D. If output C does not exceed reference value D, no fire condition signal is generated. The implementation of FIG. 4, as discussed above, suffers from a limitation that if the type of fire which is detected causes a high output on detector 1, but causes a zero output on detector 2, output C in FIG. 4 would be zero, and a fire condition would not be signalled even if a fire existed. Using a very low reference value in the embodiment of FIG. 5, this problem can be eliminated; however, this would cause a significantly high incidence of false alarms, and therefore be unacceptable. The embodiment of FIGS. 6 and 7 are therefore directed to addressing the zero condition signal. Referring to FIG. 6, input circuit 305 receives signals A and B from detectors 1 and 2, and first multiplies signals A and B, and then adds at least one and optionally two of the individual outputs A and B to the final product, thereby creating output C. Output C is compared to reference value D by comparing device 302, and a fire condition signal is sent to alarm 4 if output C exceeds reference value D. The reference value can be optimized as appropriate for particular applications.

Figure 15:
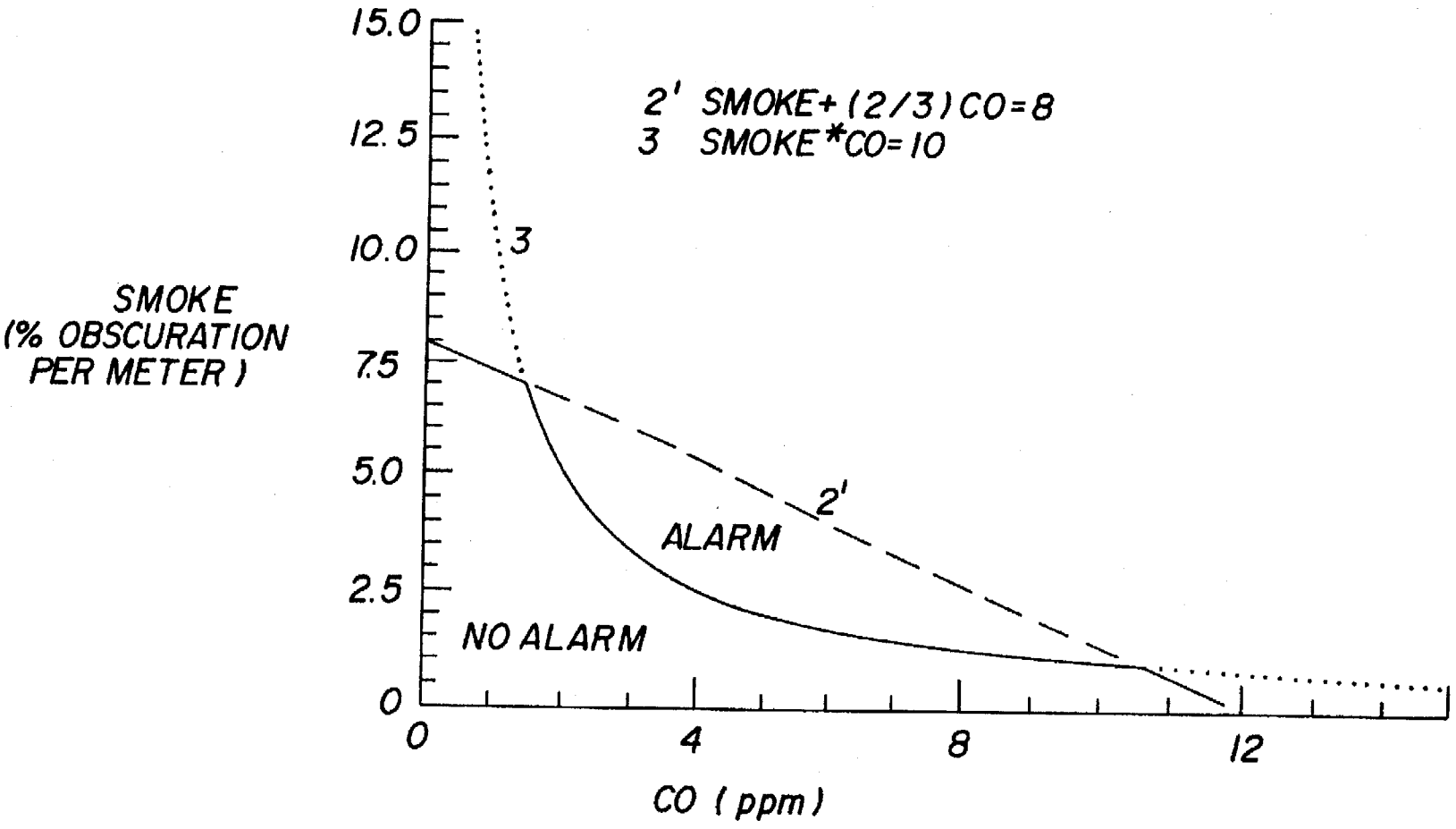
FIG. 15 illustrates an alarm curve created by combining curves 2 and 3 of FIG. 14.

Referring to FIGS. 14 and 15, one method and apparatus to eliminate the problem of near zero smoke or CO measurements is actually a combination of curves 2 and 3 using OR logic. A similar combination using AND and 0R logic is represented by curve 4. For this example, the alarm level for both the AND and OR combination is 35. Therefore, the two conditions can be represented as a single equation. This type of detection algorithm states that an alarm condition is reached when the product of the smoke and CO outputs plus the individual outputs equals a set value (AND logic). An alarm will also be signaled if the product or one of the individual signals equals the alarm value (OR logic).

By selecting different alarm thresholds and various combinations of these signals using Boolean logic, an infinite number of alarm curves can be created. FIG. 15 shows an example of an alarm curve created by combining curves 2 and 3 in FIG. 14 using OR logic with different alarm levels and weighting coefficients. Curve 2 in FIG. 14 has been changed so that the smoke measurement is weighted more in curve 2' of FIG. 15 (i.e., a line from 8 percent smoke to 12 ppm CO instead of a line from 10 percent smoke to 10 ppm CO). This change is representative of decreasing the detection algorithm sensitivity with respect to the CO component. This would tend to reduce false alarms due to CO from tobacco smoke, for example.

The dashed and dotted lines in FIG. 15 represent the individual curves for the two different detection algorithms. The solid line represents the alarm condition which results from combining the two algorithms using OR logic. An alarm is indicated if either condition 2' (Smoke+(⅔)CO≧8) OR condition 3 (Smoke,*CO≧10) is true. This alarm algorithm is more sensitive to fire sources that produce both smoke and CO than simply using curve 2'. And it sets individual alarm limits for both smoke and CO, thus avoiding the asymptotic behavior of curve 3.

Figure 19:
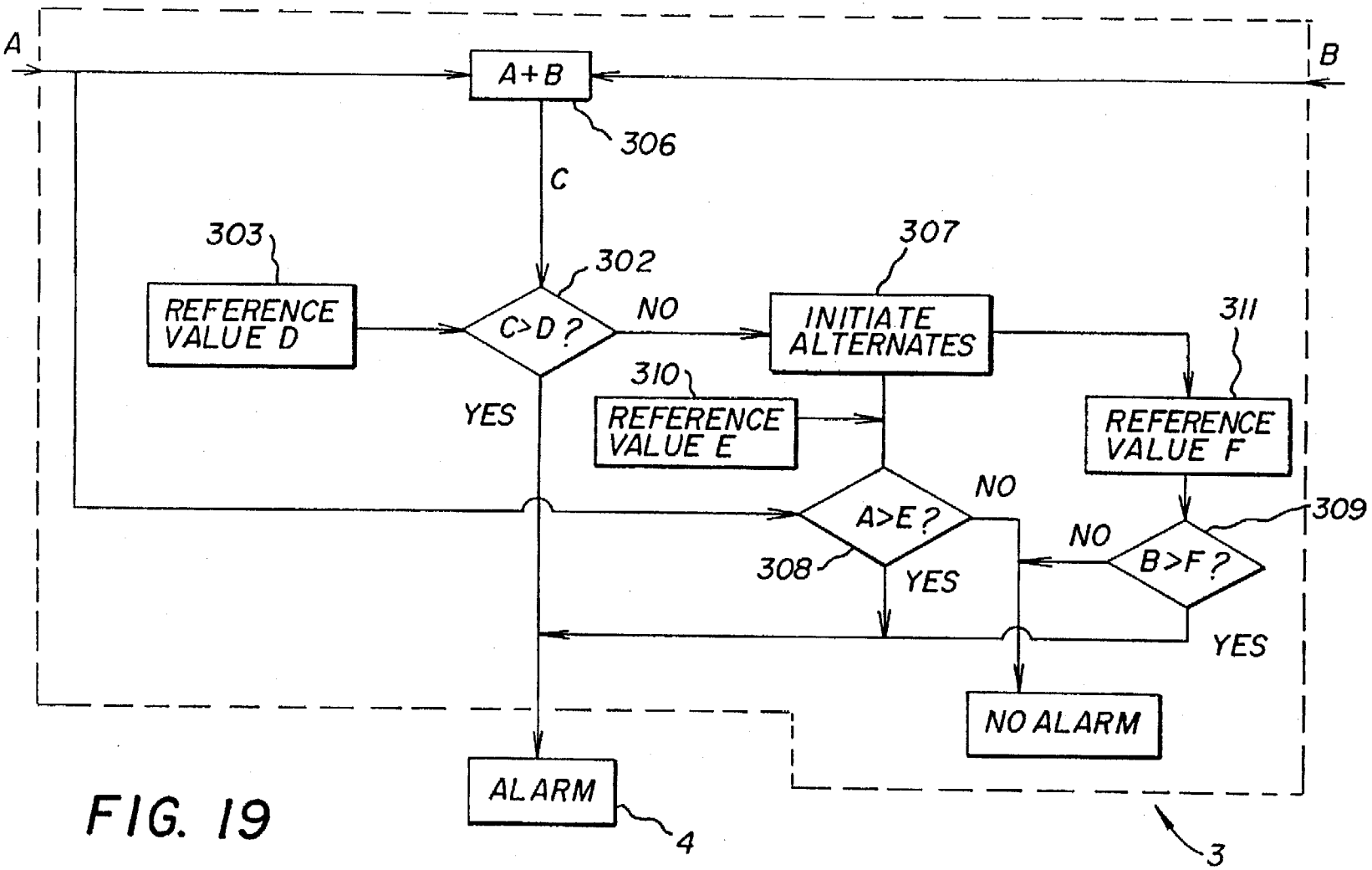
FIG. 19 illustrates an embodiment of the invention which is similar to that shown in FIG. 5, but wherein the signal processing means includes an adder instead of a multiplier of the two inputs thereof.

An embodiment of the invention which addresses the zero condition is illustrated in FIG. 7. FIG. 7 illustrates signals A and B from detectors 1 and 2 being fed in to multiplication apparatus 301, thereby forming output C. Output C is fed to comparing device 302, which compares output C to a reference value D. If output C exceeds the reference value D stored in memory 303, a fire condition signal is sent to alarm 4, therefore indicating a fire condition. If output C does not exceed reference value D, alternate initiation 307 is executed, which initiates comparing devices 308 and 309. Reference value E, stored in memory 310, is compared to output A in comparing device 308. If output A exceeds reference value E, comparing device 308 sends a fire condition signal to alarm 4. If output A does not exceed reference value E, comparing device 308 does not send any alarm signal. Simultaneously, output B is compared to reference value F, stored in memory 311. If output B exceeds reference value F, a fire condition signal is sent to alarm 4. If output B does not exceed reference value F, then no alarm is sent. With this configuration, if A is a high number and B is zero, then although output C will not exceed reference value D, output A would exceed reference value E, thereby indicating an appropriate alarm signal. Reference values D, E, and F could be set sufficiently high to minimize the amount of false alarm occurrences. FIG. 19 illustrates a similar embodiment to that shown in FIG. 7, but wherein multiplier 301 has been replaced with adder 306.

Figure 20:
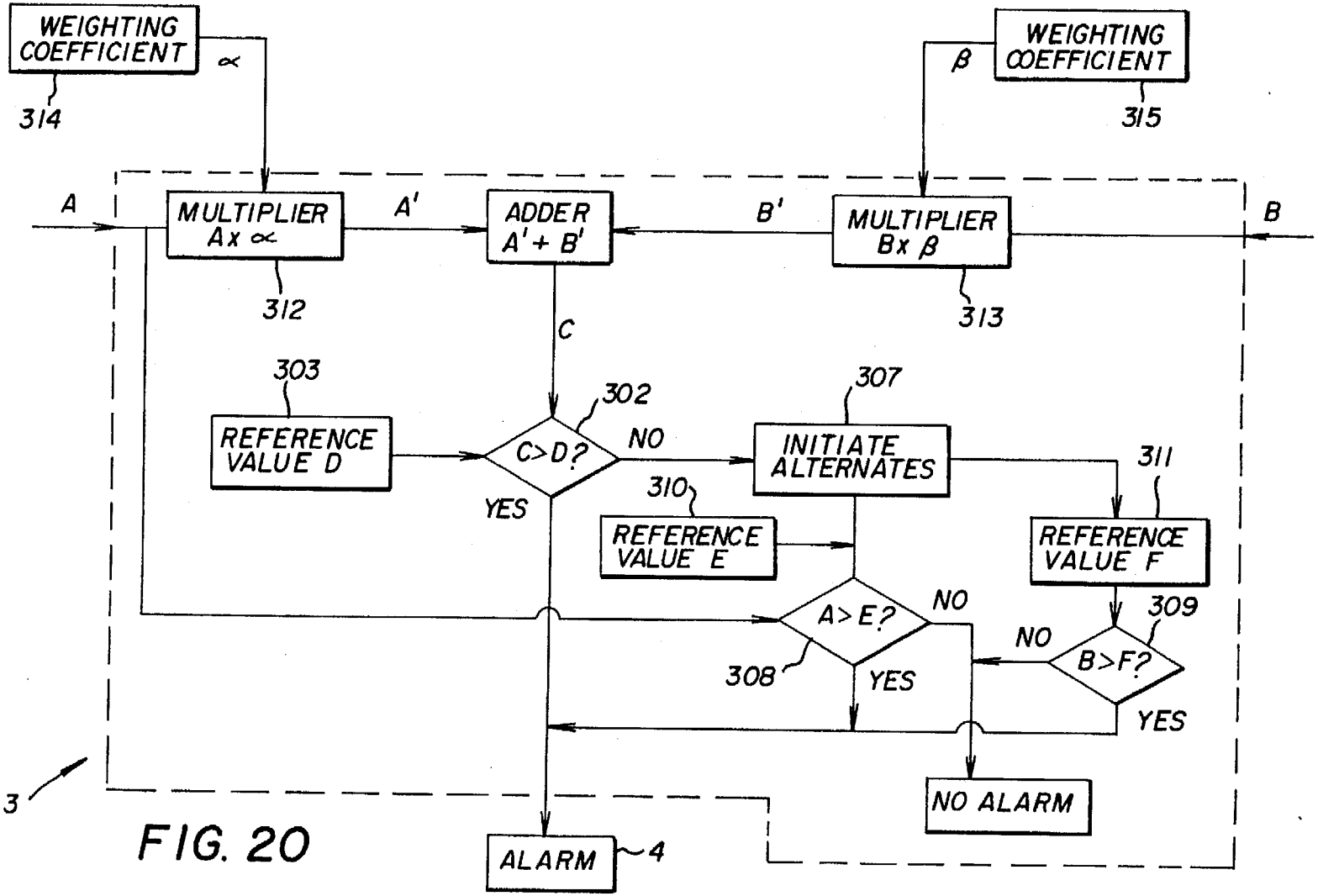
FIG. 20 illustrates an alternative embodiment of the signal processing means of the present invention.

A further embodiment of the invention is illustrated in FIG. 20; the embodiment of FIG. 20 is similar to the embodiment of FIGS. 7 and 19; however, in FIG. 20, multipliers 312 and 313 are provided to multiply inputs A and B, respectively, by weighting coefficients $\alpha$ and $\beta$, which are supplied from memories 314 and 315, respectively. These weighting coefficients can be determined based upon particular applications, wherein the inputs from one of detectors A and B may need to be weighted to have a higher weighting value in order to ensure accurate fire detection for the particular application. The determination of the particular weighting coefficients is within the purview of a person of ordinary skill in the art, in view of the information contained herein.

Figure 21:
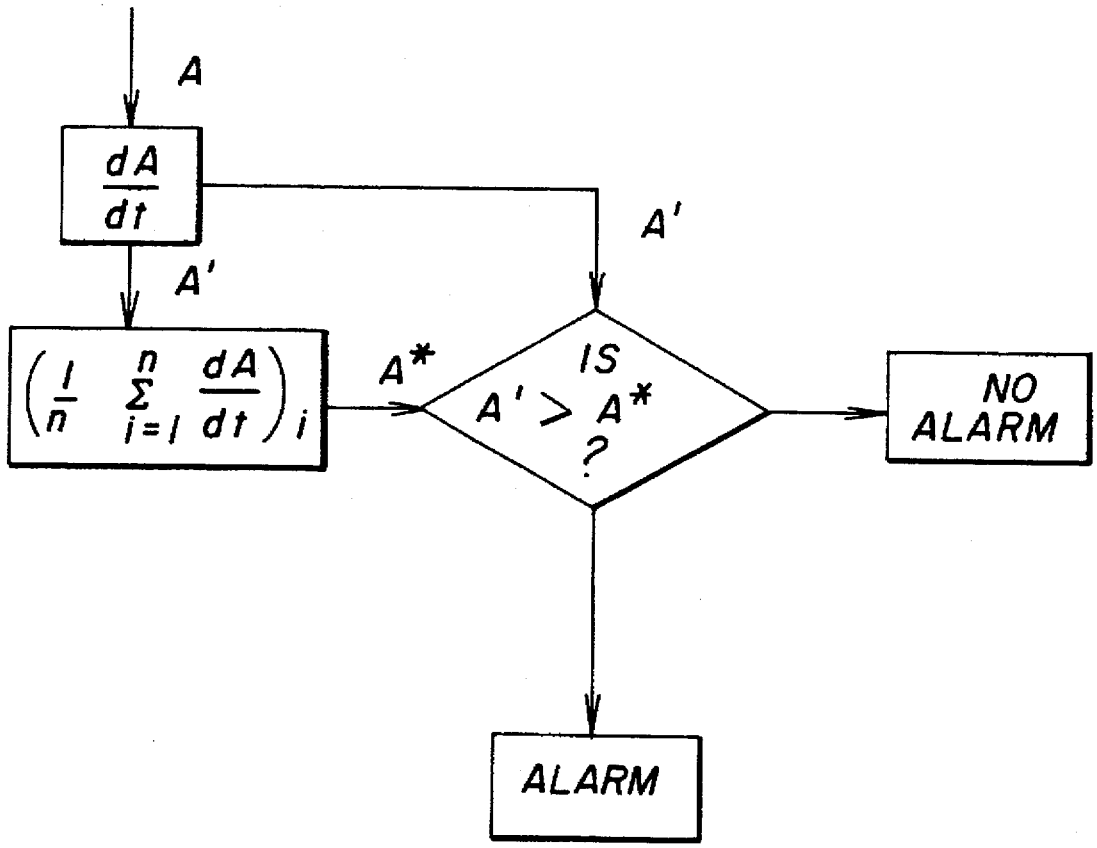
FIG. 21 illustrates yet another aspect of the invention, wherein detector output is input to a differentiator.

FIG. 21 illustrates an embodiment of the invention where the output of detector 1 is input to a differentiator which calculates a rate of change of the output signal over time $$\frac{dA}{dt},$$

and wherein the output of the differentiator is provided to a circuit which performs the mathematical equation:

$$\frac{1}{n}\sum_{i=1}^{n}\frac{dA}{dt}\Big)_i$$

The output of this calculation means, A* is then compared to the output A' of the differentiator. If A' is greater than A*, a fire condition is signalled. If A' is not greater than A*, then no alarm is sounded. The circuit of FIG. 21 can be implemented on one or both of outputs A and B of detectors 1 and 2, and can be used in conjunction with the circuitry of any of the other embodiments of the invention.

The specific circuitry necessary to implement the embodiment of the invention illustrated in the drawings would be known to a person of ordinary skill in the art, based upon the explanation of the invention contained here in. The various embodiment s of the invent ion, as discussed herein, could be implemented in a number of ways. A hardware engineer could implement the algorithm using discrete logic components, to implement the means which perform the functions set forth above. The embodiments could, in one alternative, be implemented in one of many available types of ROM, or in a suitable hardware location to form a self contained unit with the detectors at local detection sites. An alternative embodiment could comprise the detectors being locally disposed at a detector site, and the detector signals being fed back to a remote computer which is configured to analyze and process the outputs according to the above-discussed embodiments. The figures illustrate various reference values and coefficients being stored in memory locations both in and outside of the signal processors. For the purposes of this invention, the memory locations storing the actual reference value and coefficient value information may be part of the signal processor, or may be fed to the signal processor from an external memory source. As indicated above, specific configurations of the invention may vary widely depending on the particular desired application. The specific elements of the methods and apparatuses of the present invention are clearly set forth in the appended claims.

Tables 3 and 4 show comparisons between the time to alarm for detectors and for two different detection algorithms. In both comparisons, the time to alarm for the detectors was based on an alarm value of 4.8 percent obscuration per meter (1.5% per ft). Both tables compare the detector alarm times to the alarm times based on a detection algorithm criterion that the product of the change in CO concentration (ppm) and the smoke obscuration (percent per meter) is greater than or equal to 10. All tests shown represent quiescent conditions in the compartment.

In Table 3, the smoke obscuration measurement is taken from the ionization detector. Overall, the algorithm (Ion*CO=10) proved to be a better means of distinguishing between fire and non-fire threats than the smoke detectors alone. Compared to the ionization detector, the multi-signature technique resulted in the same number of false alarms. Each alarmed for a test consisting of cigarette smoke and a test of frying bacon on the gas burner. However, the multi-signature detection algorithm did provide some improvement in fire detection. The ionization detector never alarmed for smoldering PVC cable, but an alarm level was obtained when using the multi-signature detection algorithm.

TABLE 3

Comparison Between the Time to Alarm for the Ionization (ION) and Photoelectric (PHOTO) Detectors and the ION*CO criterion

| | Test | ION 1.5%/ft | PHOTO 1.5%/ft | ION*CO 10 |
|---|---|---|---|---|
| Non-fire Threats | | | | |
| Cigarettes | 59 | 49 | 521 | 44 |
| Hair spray | 69 | — | 91 | — |
| Dust | 75 | — | 45 | — |
| Cooking oil | 11 | — | 701 | — |
| Bacon (*, gas burner) | 61 | 130 | 241 | 87 |
| Bacon (*, hot plate) | 64 | — | 641 | — |
| Fire Threats | | | | |
| Wood 400° C. | 25 | 471 | 151 | 172 |
| Cotton wick | 7 | 484 | 855 | 331 |
| PVC cable | 28 | — | 249 | 445 |
| Smoldering paper | 17 | 83 | 88 | 79 |
| Polyurethane | 15 | 45 | 70 | 40 |
| Heptane | 3 | 79 | 289 | 71 |
| Flaming Paper | 51 | 37 | — | 28 |
| Fabric (poly/cotton) | 72 | 54 | 92 | 37 |
| Fabric (cotton) | 73 | 32 | — | 28 |

TABLE 4

Comparison between the Time to Alarm for the Ionization (ION) and Photoelectric (PHOTO) Detectors and the PHOTO*CO criterion

| | Test | ION 1.5%/ft | PHOTO 1.5%/ft | PHOTO *CO 10 |
|---|---|---|---|---|
| Non-fire Threats | | | | |
| Cigarettes | 59 | 49 | 521 | 87 |
| Hair spray | 69 | — | 91 | 91 |
| Dust | 75 | — | 45 | — |
| Cooking oil | 11 | — | 701 | — |
| Bacon (*, gas burner) | 61 | 130 | 241 | 151 |
| Bacon (*, hot plate) | 64 | — | 641 | 735 |
| Fire Threats | | | | |
| Wood 400° C. | 25 | 471 | 151 | 134 |
| Cotton wick | 7 | 484 | 855 | 403 |
| PVC cable | 28 | — | 249 | 296 |
| Smoldering paper | 17 | 83 | 88 | 88 |
| Polyurethane | 15 | 45 | 70 | 66 |

TABLE 4-continued

Comparison between the Time to Alarm for the Ionization (ION) and Photoelectric (PHOTO) Detectors and the PHOTO*CO criterion

| | Test | ION 1.5%/ft | PHOTO 1.5%/ft | PHOTO *CO 10 |
|---|---|---|---|---|
| Heptane | 3 | 79 | 289 | 160 |
| Flaming Paper | 51 | 37 | — | 28 |
| Fabric (poly/cotton) | 72 | 54 | 92 | 45 |
| Fabric (cotton) | 73 | 32 | — | 49 |

When compared to the photoelectric detector, the multi-signature technique showed even better improvements. The photoelectric detector produced six false alarms compared to two for the multi-signature algorithm. The detector also failed to alarm for the test with flaming paper and the test with cotton fabric. Use of the multi-signature algorithm resulted in alarms for both of these tests.

Table 4 compares the detector alarm performance against the multi-signature algorithm criterion using the photoelectric detector output (i.e., Photo*CO=10). The results are the same as those for the Ion*CO detection algorithm, except that the Photo*CO detection algorithm produced additional false alarm conditions for the tests with hair spray and for frying bacon on the hot plate. One small improvement was that for the cigarette test the multi-signature algorithm did not produce a false alarm until 38 seconds after the ionization detector alarmed.

Tables 3 and 4 also show that the two multi-signature algorithms result in shorter detection times for fire threat sources. In Table 3 it can be seen for all sources that the ION*CO detection algorithm provided shorter times to alarm than the ionization detector. Compared to the photoelectric detector, faster response times were achieved with the multi-signature detection algorithm for all sources except smoldering wood and PVC cable.

As can be seen in Table 4, the Photo*CO detection algorithm was not as successful as the Ion*CO detection algorithm in shortening the time to alarm. This is partially indicated in that for most fire threat sources, the Ion*CO detection algorithm provided shorter times to alarm than did the Photo*CO detection algorithm. In comparison to the ionization detector, the Photo*CO detection algorithm produced shorter alarm times in only about half of the fire threat tests. However, use of the multi-signature detection algorithm proved to be superior to using the photoelectric detector. The multi-signature detection algorithm resulted in shorter (equal for one test) alarm times in all cases except for smoldering PVC cable.

Figure 16:
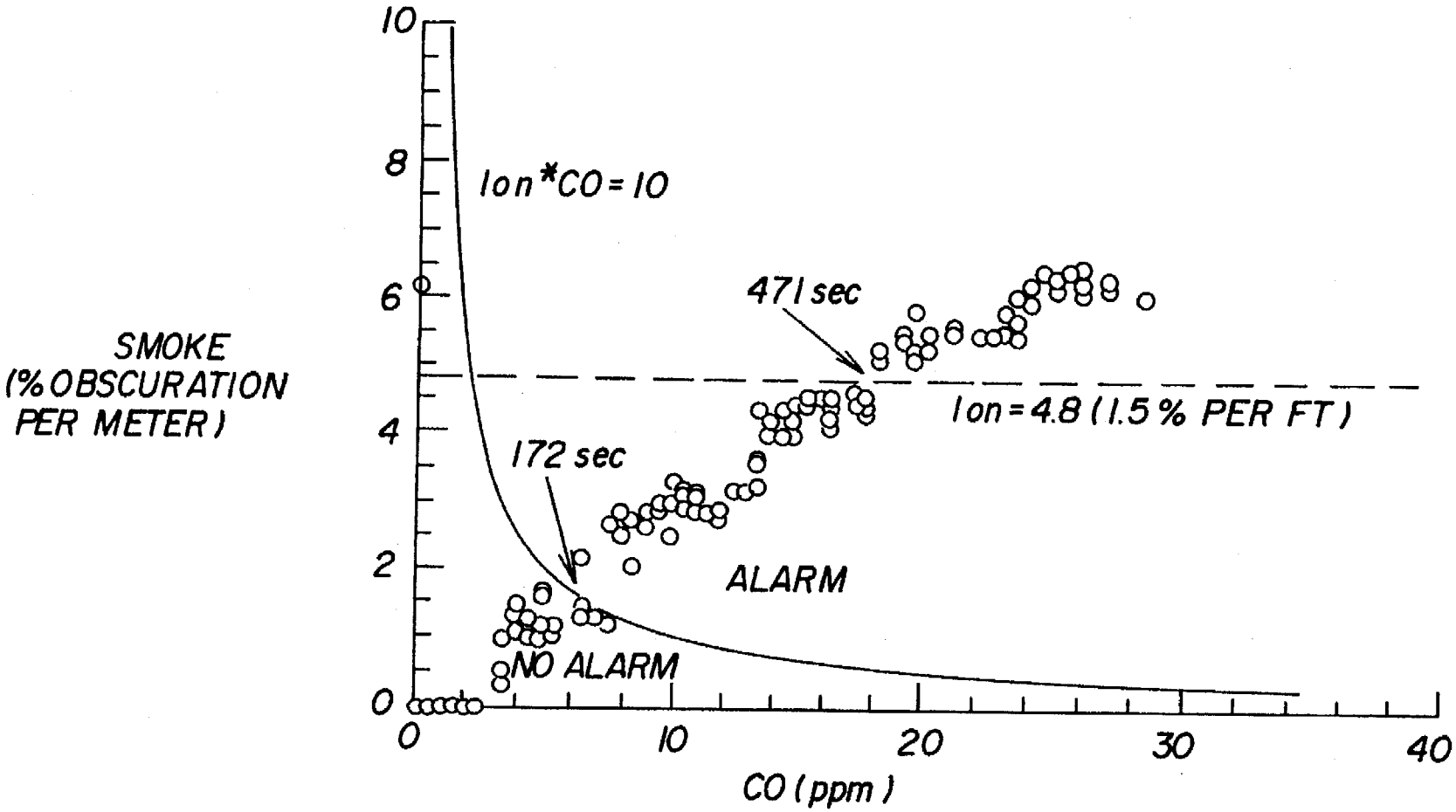
FIGS. 16 and 17 illustrate improved response times for the claimed invention.
Figure 17:
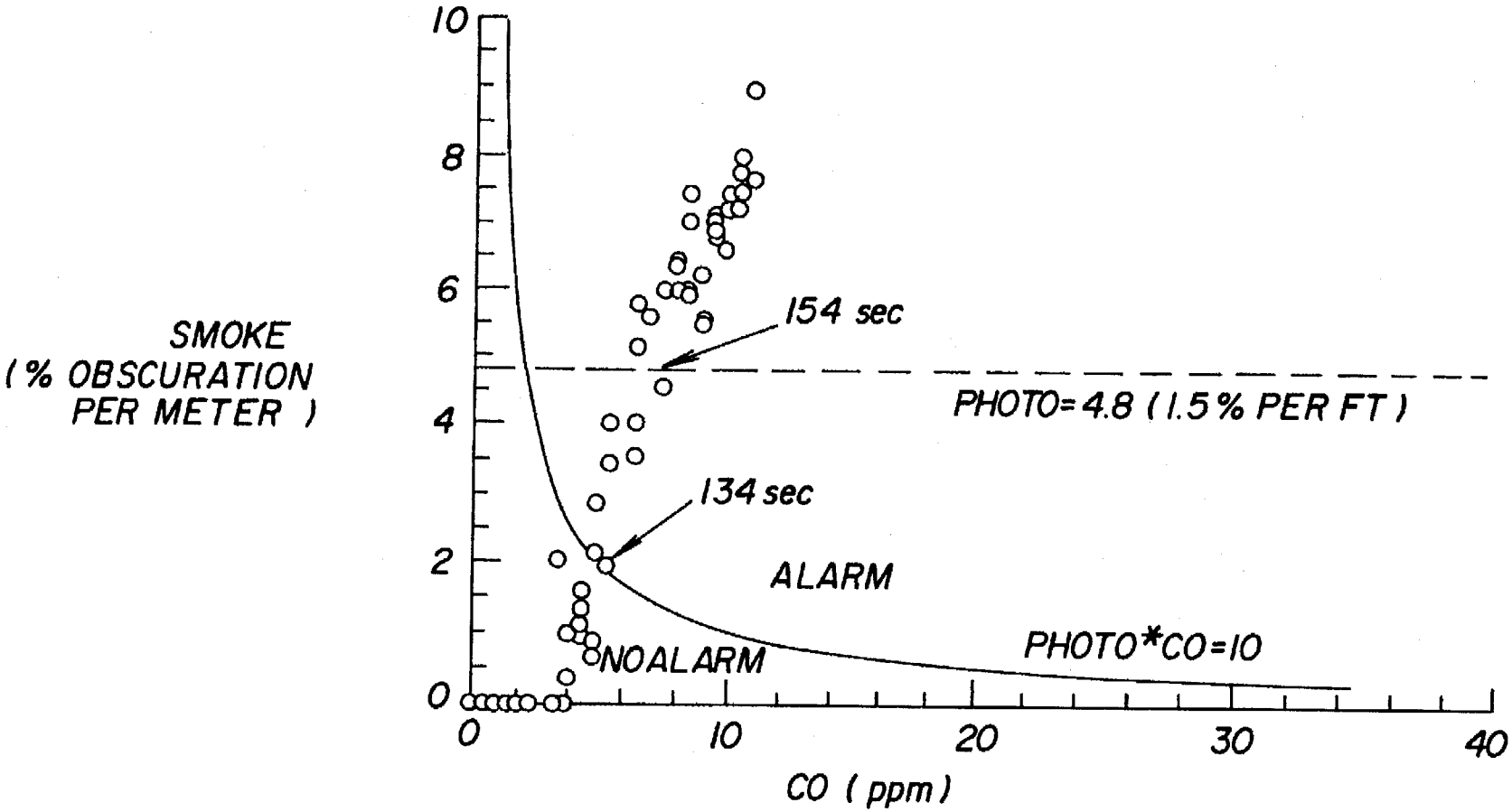

FIG. 16 and 17 show illustrations of the improved response time for the two multi-signature detection algorithms studied. FIG. 16 shows the smoke obscuration per meter measured with the ionization detector (Ion) versus the Change in CO concentration (ppm) during a smoldering wood test. On the figure are drawn two curves. Curve 1 represents the alarm level of 4.8 percent per meter for the ionization detector and curve 2 represents the multi-signature detection algorithm (Ion*CO=10). Since the smoke obscuration and CO concentrations basically increase with time, the distance from the origin (0,0) is proportional to time. In other words, a longer vector from the origin to a curve equals a longer time to alarm. It can be clearly seen that the data intersects the Ion*CO detection algorithm well before it intersects the ionization detector alarm level (curve 1). As such, the multi-signature detection algorithm results in a time to alarm of 172 seconds compared to 471 seconds for the ionization detector alone. FIG. 17 shows a similar result for the Photo*CO detection algorithm for the same smoldering wood test. This algorithm results in a time to alarm of 134 seconds compared to 151 seconds for the photoelectric detector alone.

Figure 18:
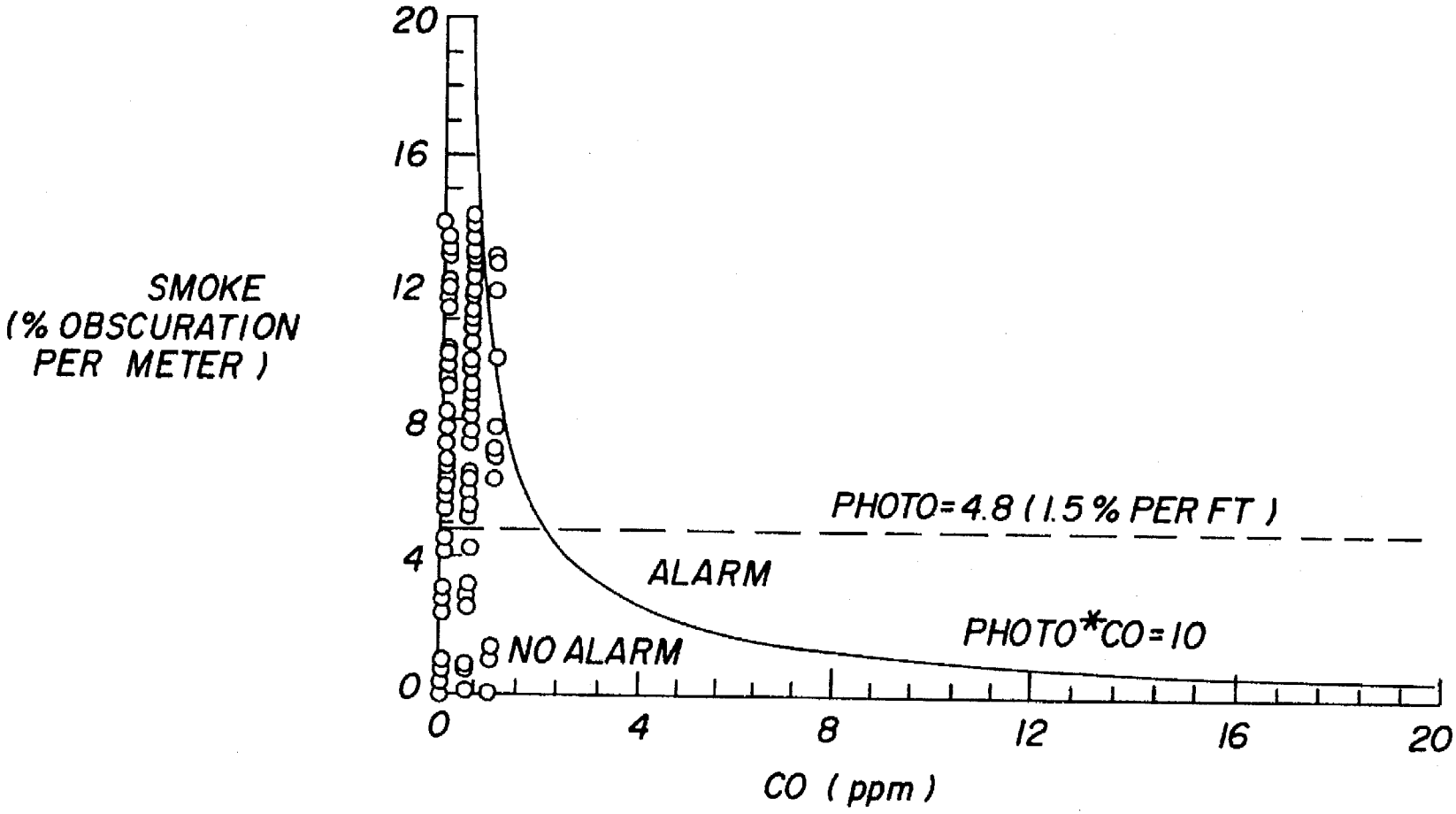
FIG. 18 illustrates the ability of the claimed invention to reduce false alarms.

FIG. 18 illustrates the ability of the multi-signature detection technique to eliminate false alarms. FIG. 18 shows the smoke obscuration per meter measured with the photoelectric detector versus the change in CO concentration for a nuisance alarm source. The source of fumes was heated cooking oil. As can be seen the cooking fumes resulted in a large photoelectric detector smoke signal that well surpassed the alarm threshold (i.e., resulted in a false alarm). In contrast, the use of a multi-signature detection algorithm eliminates the false alarm by establishing a criteria for which the smoke versus CO data lies below the curve. The few data points that lie above the alarm criteria curve were spurious data that did not occur successively in time. As most detection systems employ some signal conditioning (eg., time averaging), these data points do not represent false alarm triggers.

As discussed above, the present invention provides improved fire detection capabilities over standard smoke detectors which are known in the prior art. The improved capabilities are provided by combining two fire signatures, such as smoke measurements with CO measurements. False alarms can be reduced while increasing sensitivity, using the multi-signature detection algorithms discussed above directed to the products of the smoke or particulate detector and the CO or gas detector. Even simple algorithms resulted in a significant reduction of false alarms, compared to ionization and photoelectric detectors alone. This algorithm also resulted in shorter detection times for all fire threats than did the ionization detector.

Particular applications of the invention may require the establishment of a baseline level of fire signature, caused by manufacturing environments or other environments where a higher level than normal of particulates and gases associated with fire signatures are in the air. The invention can be configured such that the signal processing means establishes the baseline based upon a sampling process. This baseline can be based on either the average value of the fire signature or the average rate of change of the fire signature over some suitable period of time. Once this baseline is established, the signal processing means would use the difference between the instantaneous value of the fire signature and the baseline or the difference between the instantaneous rate of change of the fire signature and the baseline as input to the multi-signature detection algorithm.

Additionally, the invention can be configured such that the smoke detector, instead of sensing a specific smoke value, senses a particle size distribution, wherein the detector senses a plurality of particle sizes, and compares data regarding a particle size distribution to a threshold stored in memory. Furthermore, although the explanation of the invention discussed above is directed primarily to a multi-signature fire detection apparatus utilizing a particle detector and a gas detector, any combination of detectors can be implemented, and be within the scope of the claimed invention. Two gas detectors sensing different types of gases, or combination of smoke detector, gas detector, thermal detector, etc. can be utilized, with the output of the detectors being processed as discussed above. The combination of detectors could include smoke, carbon monoxide, temperature, carbon dioxide, hydrochloric acid, oxidizable gas, and nitrogen oxides. Other detectors can be selected, based upon the application of the apparatus.

It is readily apparent that the above-described invention has the advantage of wide commercially utility. It is understood that the specific form of the invention hereinabove described is intended to be representative only, as certain modifications within the scope of these teachings will be apparent to those of skill in the art. Therefore, in determining the full scope of the invention, reference should only be made to the following claims.

We claim:

1. A multi-signature fire detection apparatus, comprising:

first detector means for detecting a first type of fire signature, said first detector means outputting a first signal indicative of a first detected fire signal;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said first detector means detects a particulate size distribution indicative of a potential fire condition, and said second detector means detects gases indicative of the potential fire condition.

2. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire detection signal if a combination of said first and second signals exceeds said first predetermined reference value, wherein said first detector means detects smoke, and said second detector means detects carbon monoxide, wherein said combining of said first and second signals is based on a change from an ambient base line of the signal representing the output of the carbon monoxide detector.

3. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes means for adding said first and second signals, wherein said signal processing means outputs a fire condition signal if a sum of said first and second signals exceeds the first predetermined reference value, and wherein said signal processing means further includes means for multiplying each of said first and second signals by a predetermined weighting coefficient prior to adding said first and second signals, yielding weighted first and second signals, wherein said signal processing means outputs a fire condition signal if a sum of said weighted first and second signals exceeds the predetermined value.

4. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes baseline determining means for determining a baseline value for at least one of said first signal and said second signal, said baseline value being based upon an average rate of change over time of said one of said first and second signals, said signal processing means outputting a fire condition signal if an instantaneous rate of change of the one of the first and second signals exceeds the baseline value.

5. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes baseline determining means for determining a baseline value for at least one of said first signal and said second signal, said baseline value being based upon an average value of the fire signature over time of said one of said first and second signals, said signal processing means outputting a fire condition signal if the instantaneous value of one of the first and second signals exceeds the baseline value.

6. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, said apparatus further comprising first rate-of-change comparison means connected to said first detector means; and second rate-of-change comparison means connected to said second detector means, wherein said first rate-of-change comparison means compares a rate-of-change of the first signal to a first threshold rate-of-change, and said second rate-of-change comparison means compares the second signal to a second threshold rate-of-change, and wherein a fire condition signal is outputted if the rate-of-change of the first signal or of the second signal exceeds the respective first and second threshold rates-of-change, respectively.

7. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes means for multiplying said first and second signal, and outputs a fire condition signal if a product of said first and second signals exceeds the first predetermined reference value, wherein said signal processing means includes zero-condition detection means for detecting a fire condition when an output of one of said first detector means and said second detector means is below a second predetermined reference value.

8. A multi-signature fire detection apparatus as recited in claim 7, wherein said zero-condition detection means includes OR logic means for indicating the fire condition if one of said first and second detection signals exceeds one of said first and second predetermined reference values.

9. A method for detecting fires, comprising the steps of:

providing a first detector means for detecting a first fire signature, said first detector means outputting a first signal indicative of the first fire signature;

providing a second detector means for detecting a second fire signature different from said first fire signature, said second detector means outputting a second signal indicative of the second fire signature;

detecting the first fire signature with said first detector means, and generating the first signal indicative of said first fire signature;

detecting the second fire signature with said second detector means, said second detector means outputting the second signal indicative of said second fire signature;

combining said first and second signals, thereby yielding a combined result;

comparing said combined result to a first predetermined value;

comparing, if said combined result is below said first predetermined value, said first signal to a second predetermined value and said second signal to a third predetermined value;

indicating a fire condition if said combined result exceeds said first predetermined value, said first signal exceeds said second predetermined value, or said second signal exceeds said third predetermined value.

10. A method for detecting fires as recited in claim 9, wherein said step of combining said first and second signals comprises a step of multiplying said first and second signals.

11. A method for detecting fires as recited in claim 9, wherein said step of combining said first and second signals comprises a step of adding said first and second signals.

12. A multi-signature fire detection apparatus, comprising:

first detector means for detecting a first type of fire signature, said first detector means outputting a first signal indicative of a first detected fire signature;

second detector means for detecting a second type of fire signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes means for multiplying said first and second signals, and outputs a fire condition signal if a product of said first and second signal exceeds the first predetermined reference value, wherein said signal processing means further includes means for adding at least one of said first and second signals to said product, and outputs a fire condition signal if a sum of said product and said at least one of said first and second signals exceeds the first predetermined reference value.

13. A multi-signature fire detection apparatus as recited in claim 12, wherein said first detector means detects smoke indicative of a potential fire condition, and said second detector means detects gases indicative of the potential fire condition.

14. A multi-signature fire detection apparatus as recited in claim 12, wherein said first detector means detects a first gas indicative of a potential fire condition, and said second detector means detects a second gas indicative of the potential fire condition.

15. A multi-signature fire detection apparatus as recited in claim 12, wherein said first detector means detects particulates indicative of a potential fire condition, and said second detector means detects a temperature which is indicative of the potential fire condition.

16. A multi-signature fire detection apparatus as recited in claim 12, wherein said first detector means detects temperature indicative of a potential fire condition, and said second detector means detects gases indicative of the potential fire condition.

17. A multi-signature fire detection apparatus as recited in claim 12, wherein said first detector means detects at least one first type of fire signature selected from the group of fire signatures consisting of smoke, carbon monoxide, temperature, carbon dioxide, hydrochloric acid, oxidizable gas, and nitrogen oxides, and said second detector means detects at least one second type of fire signature selected from the group of fire signatures consisting of smoke, carbon monoxide, temperature, carbon dioxide, hydrochloric acid, oxidizable gas, and nitrogen oxides.

18. A multi-signature fire detection apparatus, comprising:

first detector means for detecting a first type of fire signature, said first detector means outputting a first signal indicative of a first detected fire signature;

second detector means for detecting a second type of first signature, said second detector means outputting a second signal indicative of a second detected fire signature;

signal processing means for combining said first and second signals, wherein outputs of said first and second detector means are coupled to said signal processing means, said signal processing means comparing said first and second signals to a first predetermined reference value, and outputting a fire condition signal if a combination of said first and second signals exceeds said first predetermined reference value, wherein said signal processing means includes means for multiplying said first and second signals, and outputs a fire condition signal if a product of said first and second signals exceeds the first predetermined reference value, wherein said signal processing means includes means for comparing said product of said first and second signals to said first predetermined reference value, and means for comparing, if said product is below said first predetermined value, each of said first and second signals to second and third predetermined values, said signal processing means indicating a fire condition if one of said first and second signals exceeds one of said second and third predetermined reference values.

19. A multi-signature fire detection apparatus as recited in claim 18, wherein said first detector means detects smoke indicative of a potential fire condition, and said second detector means detects gases indicative of the potential fire condition.

20. A multi-signature fire detection apparatus as recited in claim 18, wherein said first detector means detects a first gas indicative of a potential fire condition, and said second detector means detects a second gas indicative of the potential fire condition.

21. A multi-signature fire detection apparatus as recited in claim 18, wherein said first detector means detects particulates indicative of a potential fire condition, and said second detector means detects a temperature which is indicative of the potential fire condition.

22. A multi-signature fire detection apparatus as recited in claim 18, wherein said first detector means detects temperature indicative of a potential fire condition, and said second detector means detects gases indicative of the potential fire condition.

23. A multi-signature fire detection apparatus as recited in claim 18, wherein said first detector means detects at least one first type of fire signature selected from the group of fire signatures consisting of smoke, carbon monoxide, temperature, carbon dioxide, hydrochloric acid, oxidizable gas, and nitrogen oxides, and said second detector means detects at least one second type of fire signature selected from the group of fire signatures consisting of smoke, carbon monoxide, temperature, carbon dioxide, hydrochloric acid, oxidizable gas, and nitrogen oxides.

24. A multi-signature fire detection apparatus, comprising:

first detecting means for detecting a first fire signature, said first detecting means outputting a first signal indicative of the first fire signature;

second detecting means for detecting a second fire signature different from said first fire signature, and outputting a second signal indicative of the second fire signature;

signal processing means coupled to said first and second detecting means, said signal processing means for combining said first and second signals, thereby yielding a combined result, said signal processing means including first comparing means for comparing said combined result to a first predetermined value, and second comparing means for comparing, if said combined result is below said first predetermined value, said first signal to a second predetermined value and said second signal to a third predetermined value; and indicating means for indicating a fire condition if said combined results exceeds said first predetermined value, said first signal exceeds said second predetermined value, or said second signal exceeds said third predetermined value.

25. A multi-signature fire detection apparatus as recited in claim 24, wherein said signal processing means includes means for adding said first and second signals, and wherein said signal processing means outputs a fire condition signal if a sum of said first and second signals exceeds the first predetermined reference value.

26. A multi-signature fire detection apparatus as recited in claim 25, wherein said signal processing means further includes means for multiplying each of said first and second signals by a predetermined weighting coefficient prior to adding said first and second signals, yielding weighted first and second signals, wherein said signal processing means outputs a fire condition signal if a sum of said weighted first and second signals exceeds the predetermined value.

27. A multi-signature fire detection apparatus as recited in claim 24, wherein said signal processing means includes means for multiplying said first and second signals, and wherein said signal processing means outputs a fire condition signal if a second signals first and second signals exceeds the first predetermined reference value.

* * * * *

UNITED STATES PATENT AND TRADEMARK OFFICE

CERTIFICATE OF CORRECTION

PATENT NO. : 5,691,703
DATED : November 25, 1997
INVENTOR(S) : Roby et al.

It is certified that error appears in the above-identified patent and that said Letters Patent is hereby corrected as shown below:

Column 1,
Line 4, please add to the specification at the beginning the following required phrase:

-- This invention was made with Government support under Contract nos. 50-DKNA-4-00146 and 50-DKNA -3-00116 awarded by the National Oceanic and Atmospheric Administration. The Government has certain rights in this invention. --

Signed and Sealed this

Fourth Day of March, 2003

JAMES E. ROGAN
*Director of the United States Patent and Trademark Office*